US008359982B2

(12) United States Patent
Lebel et al.

(10) Patent No.: US 8,359,982 B2
(45) Date of Patent: Jan. 29, 2013

(54) SELF-STOWING SUPPORT TABLE WITH ARTICULATING ARM

(76) Inventors: Martin Lebel, Quebec (CA); Eric Lebel, Tiburon, CA (US)

( * ) Notice: Subject to any disclaimer, the term of this patent is extended or adjusted under 35 U.S.C. 154(b) by 510 days.

(21) Appl. No.: 12/538,626

(22) Filed: Aug. 10, 2009

(65) Prior Publication Data

US 2010/0275821 A1 Nov. 4, 2010

Related U.S. Application Data

(60) Provisional application No. 61/136,365, filed on Sep. 2, 2008.

(51) Int. Cl.
*A47B 3/00* (2006.01)

(52) U.S. Cl. ..... 108/44; 108/7; 248/276.1

(58) Field of Classification Search ..... 108/20, 108/3–5, 138, 140, 141, 143, 145, 42, 44; 312/223.3; 248/276.1, 281.11, 285.1, 286.1, 248/288.31; 297/144, 147, 173
See application file for complete search history.

(56) References Cited

U.S. PATENT DOCUMENTS

| | | | | | |
|---|---|---|---|---|---|
| 2,612,422 | A * | 9/1952 | Sarkus | 108/141 |
| 3,795,815 | A * | 3/1974 | Weinstock et al. | 378/178 |
| 4,437,638 | A * | 3/1984 | Scheibenpflug | 248/183.2 |
| 4,703,909 | A * | 11/1987 | Dayton et al. | 248/280.11 |
| 4,796,162 | A * | 1/1989 | Krogsrud | 362/33 |
| 5,129,702 | A * | 7/1992 | Ervin | 297/144 |
| 5,673,628 | A * | 10/1997 | Boos | 108/44 |
| 5,680,820 | A * | 10/1997 | Randolph | 108/25 |
| 5,857,415 | A * | 1/1999 | Richard | 108/50.01 |
| 6,012,693 | A * | 1/2000 | Voeller et al. | 248/280.11 |
| 6,076,785 | A * | 6/2000 | Oddsen, Jr. | 248/118.3 |
| 6,203,109 | B1 * | 3/2001 | Bergsten et al. | 297/411.35 |
| 6,394,403 | B1 * | 5/2002 | Hung | 248/276.1 |
| 6,502,261 | B1 * | 1/2003 | Harwood | 5/611 |
| 6,793,281 | B2 * | 9/2004 | Duerr et al. | 297/147 |
| 7,014,157 | B2 * | 3/2006 | Oddsen | 248/280.11 |
| 7,207,537 | B2 * | 4/2007 | Hung | 248/284.1 |
| 7,395,995 | B2 * | 7/2008 | Chen | 248/284.1 |
| 7,510,155 | B2 * | 3/2009 | Huang et al. | 248/278.1 |
| 7,568,760 | B1 * | 8/2009 | Lodes | 297/217.7 |
| 7,585,033 | B2 * | 9/2009 | Holt | 312/311 |
| 7,614,597 | B2 * | 11/2009 | Matsumoto et al. | 248/429 |
| 7,887,014 | B2 * | 2/2011 | Lindblad et al. | 248/123.11 |
| 2003/0173482 | A1 * | 9/2003 | Kuhn | 248/276.1 |
| 2006/0054751 | A1 * | 3/2006 | Johnson et al. | 248/123.11 |
| 2008/0029670 | A1 * | 2/2008 | Hung | 248/278.1 |

* cited by examiner

*Primary Examiner* — Janet M Wilkens
(74) *Attorney, Agent, or Firm* — Equinox Protection; Franz Bonsang

(57) ABSTRACT

A support table device comprises a base for being positioned on a surface, a table member for supporting articles thereon; and an articulating arm mounted at one end to the base. The table member is pivotally mounted to the articulating arm at the other end thereof. The articulating arm comprises at least two arm segments joined about an arm joint therebetween for relative pivotal movement. The articulating arm and table are movable between a stowed position, with the table member being near the base and a deployed position with the table being away from the base.

18 Claims, 31 Drawing Sheets

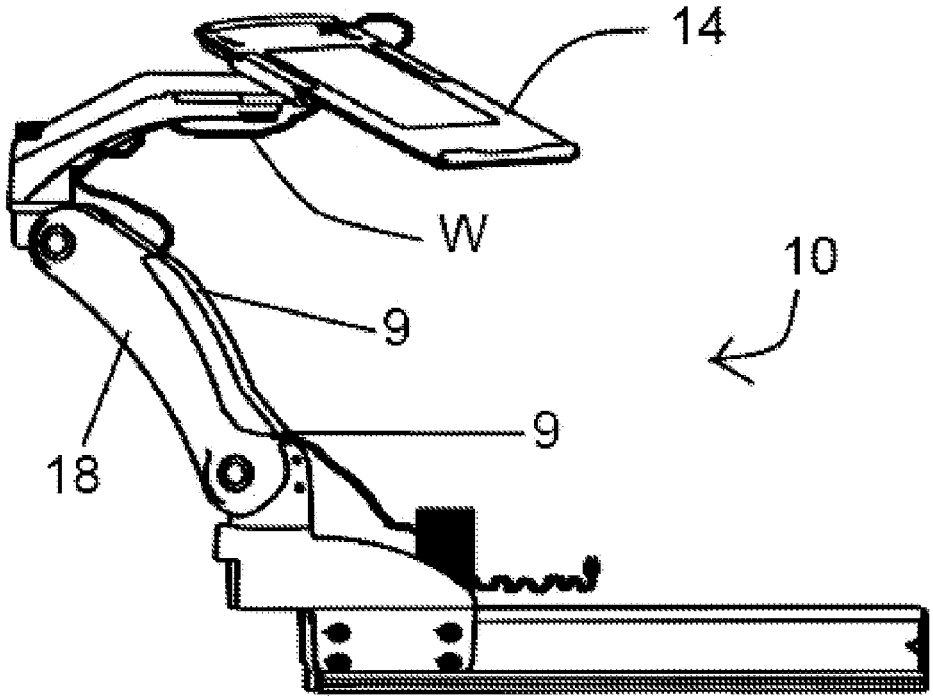
FIG.13
FIG. 14
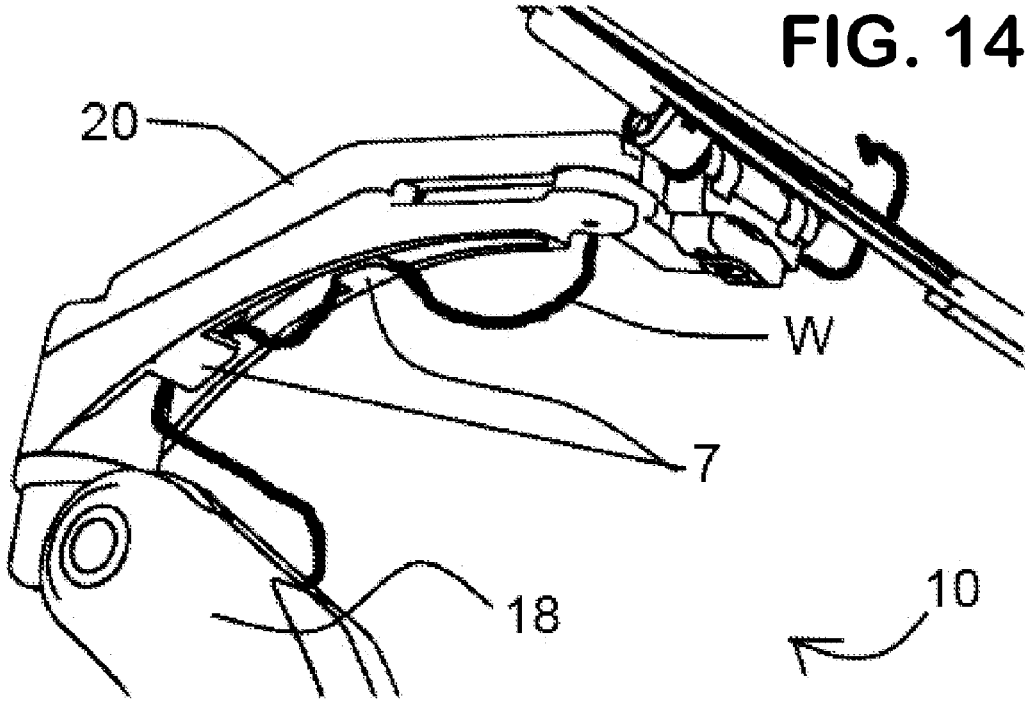

SELF-STOWING SUPPORT TABLE WITH ARTICULATING ARM

CROSS-REFERENCE TO RELATED APPLICATION

The present application request priority on U.S. Provisional Application No. 61/136,365 filed Sep. 2, 2008 and incorporated herein by reference in its entirety.

FIELD OF THE INVENTION

The present invention relates to a support table device. More specifically but not exclusively, the present invention relates to a self-stowing support table with an articulating arm.

BACKGROUND OF THE INVENTION

Various tables for a variety of uses such as computer tables, work tables, or coffee tables are known. Many such tables, especially those destined to support a computer such as a lap top computer can be provided with an arm and a base.

A drawback with conventional thereby providing the user to move the table relative to the base, selectively positioning the computer at a desired position. A draw back with conventional tables having an articulating arm is that they cannot be easily stowed away.

OBJECTS OF THE INVENTION

An object of the present invention is to provide a self-stowing support table with an articulating arm.

SUMMARY OF THE INVENTION

In accordance with an aspect of the invention, there is provided a support table device comprising:

a base for being positioned on a surface;

a table member for supporting articles thereon; and an articulating arm mounted at one end thereof to the base, the table member being pivotally mounted to the articulating arm at the other end thereof, the articulating arm comprising at least two arm segments joined about an arm joint therebetween for relative pivotal movement, wherein the articulating arm and table are movable between a stowed position wherein the table member is near the base and a deployed position wherein the table is away from the base.

Other objects, advantages and features of the present invention will become more apparent upon reading of the following non-restrictive description of illustrative embodiments thereof, given by way of example only with reference to the accompanying drawings.

BRIEF DESCRIPTION OF THE DRAWINGS

In the appended drawings:

FIGS. 13 and 14 are perspective views of the articulating arm of the support table device of FIG. 1;

DETAILED DESCRIPTION OF THE ILLUSTRATIVE EMBODIMENTS

With reference to the appended drawings, an embodiment of the present support table device will be described herein so as to exemplify the invention and by no means limit the scope thereof.

Generally stated, in an embodiment, the invention relates to a support table device comprising a base, an articulating arm mounted at one end thereof to the base, and a table member being movably mounted to the articulating arm at the other end thereof. The base member is configured to be positioned on a surface such as a floor and/or furniture. The articulating arm is retractable towards the base member and extendable away from the base member. The table member provides for supporting articles thereon. The articulating arm provides for reciprocally moving the table member from a stowed position near the base when retracted to a deployed position away from the base when extended. In another embodiment, the device comprises an enclosure. The base is mounted to this enclosure and the table member and arm as well as the base can be stowed within this enclosure. The arm is outwardly extendable from the enclosure when the device is in the deployed configuration. The support table devices of the invention can be mounted to couches, beds, chairs, lawn chairs as well other typed of furniture, such as acting as auxiliary tables to a desk, for a variety of uses.

With reference to FIGS. 1 to 11, a table support device 10, in accordance with a first non restrictive illustrative embodiment of the present invention will no be described.

Figure 1:
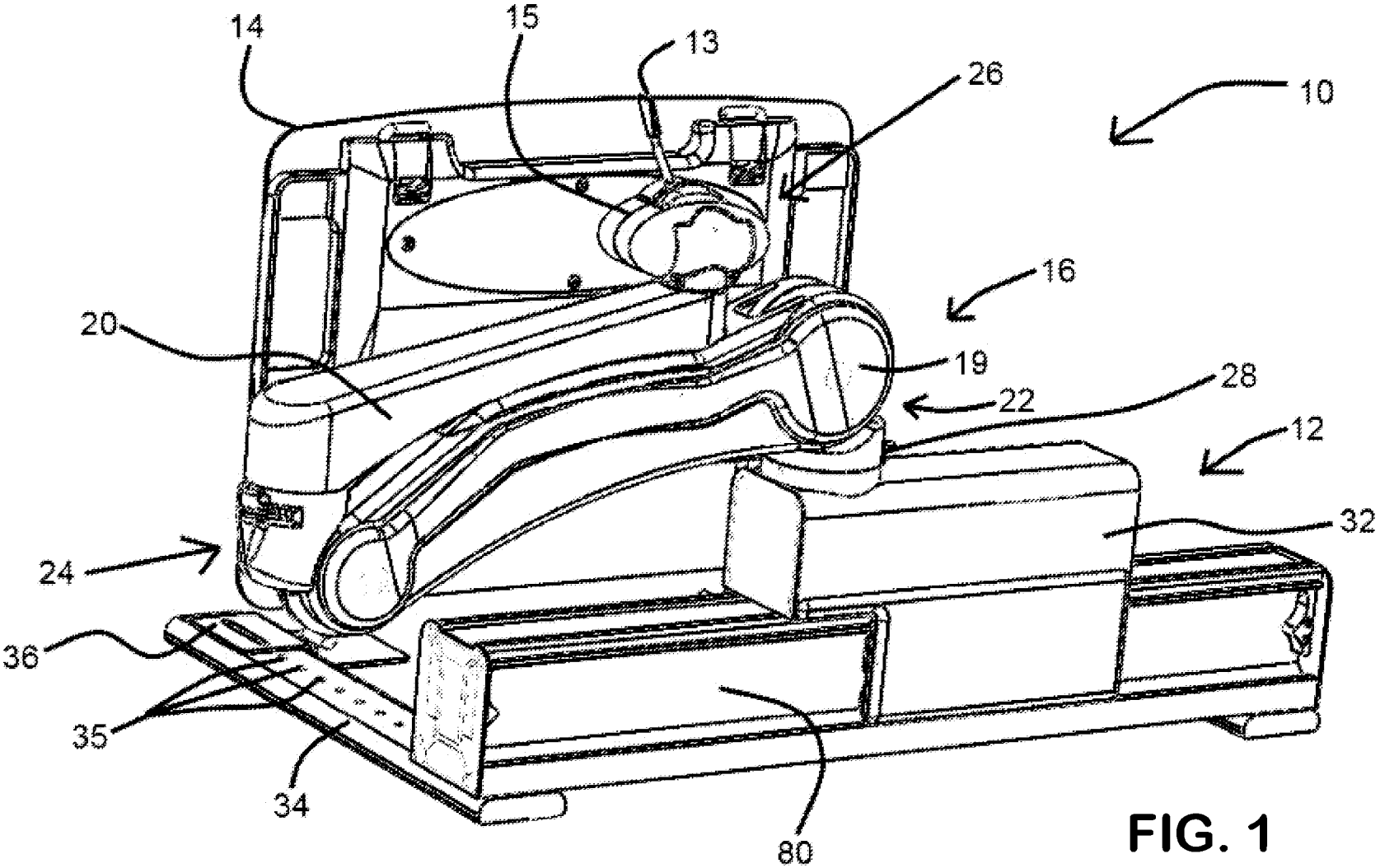
FIG. 1 is a perspective view of the support table device in a fully stowed position in accordance with a non-restrictive illustrative embodiment of the present invention.
Figure 2:
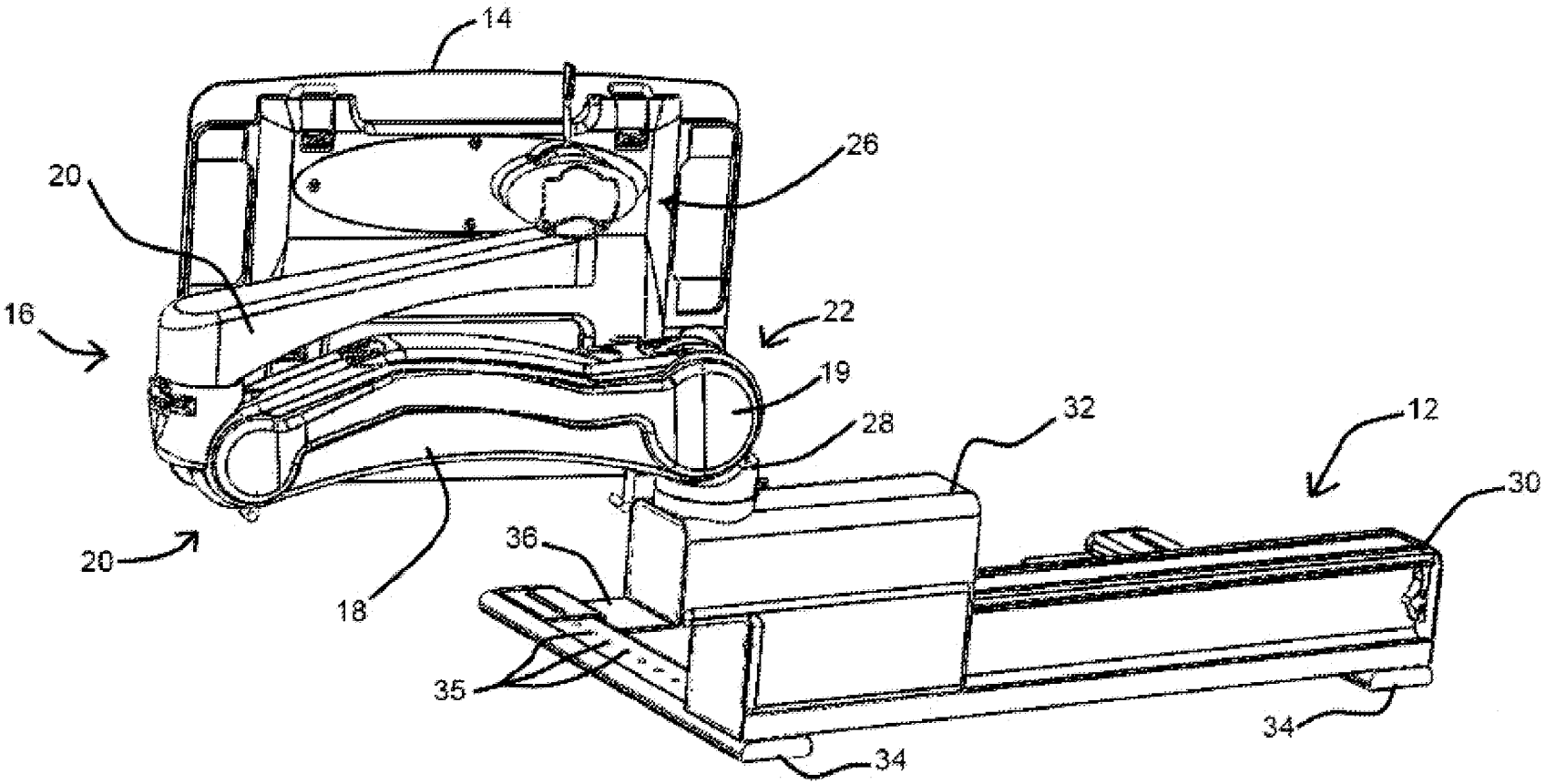
FIG. 2 is a perspective view of the support table device of FIG. 1 is an almost fully stowed position.
Figure 3:
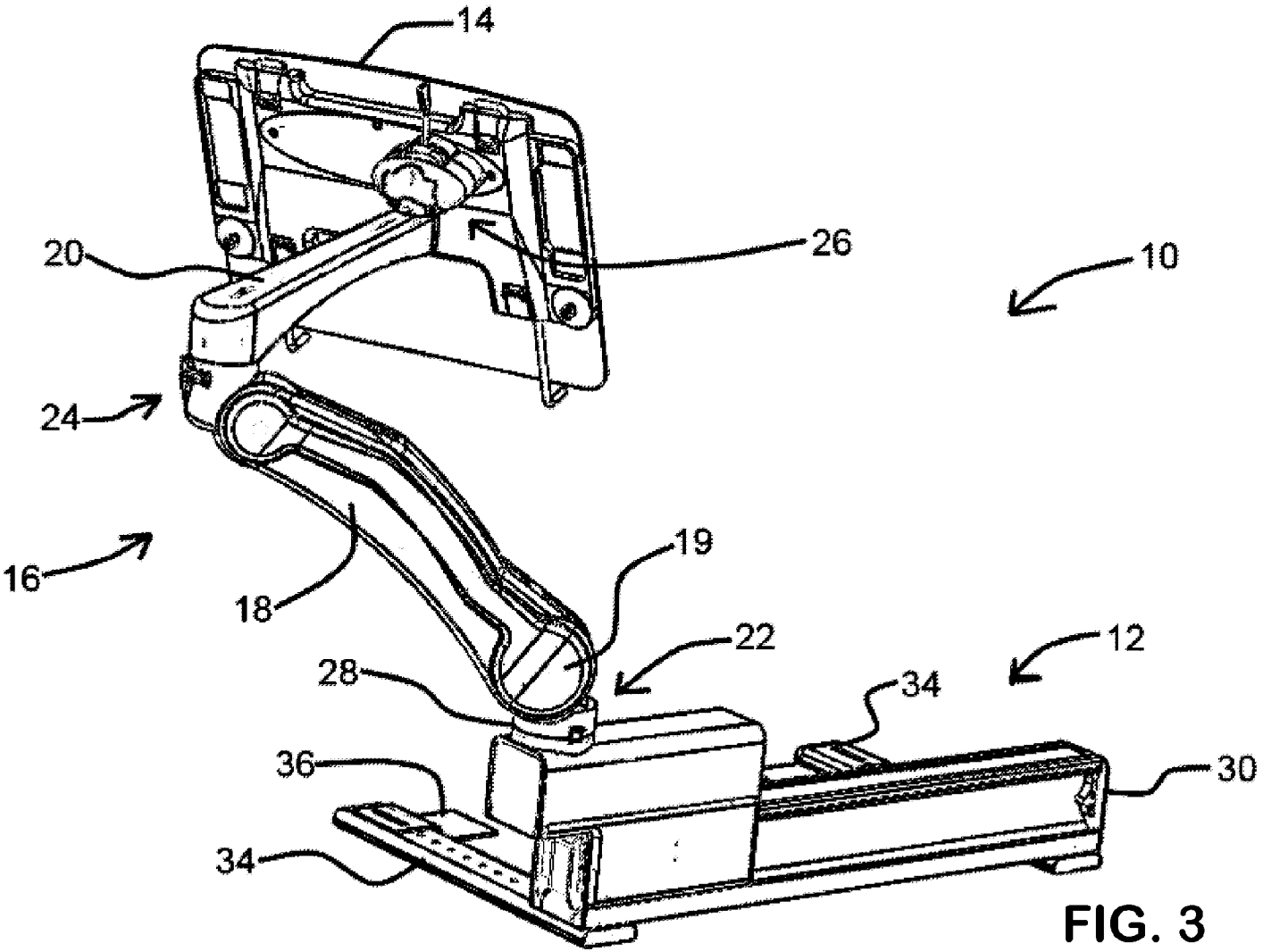
FIGS. 3, 4 and 5 are perspective views of the table device of FIG. 1 in a deployed position.
Figure 4:
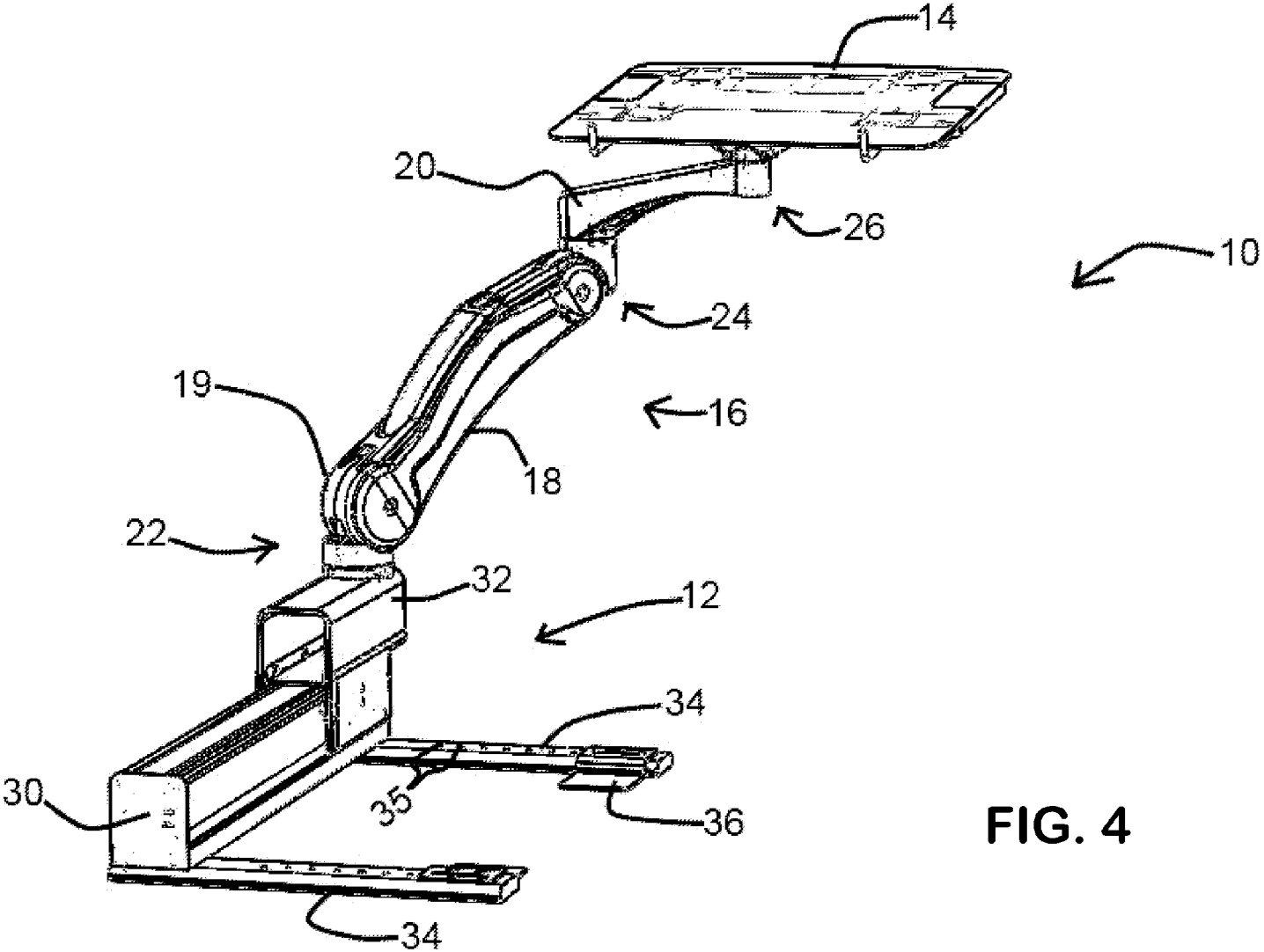
Figure 5:
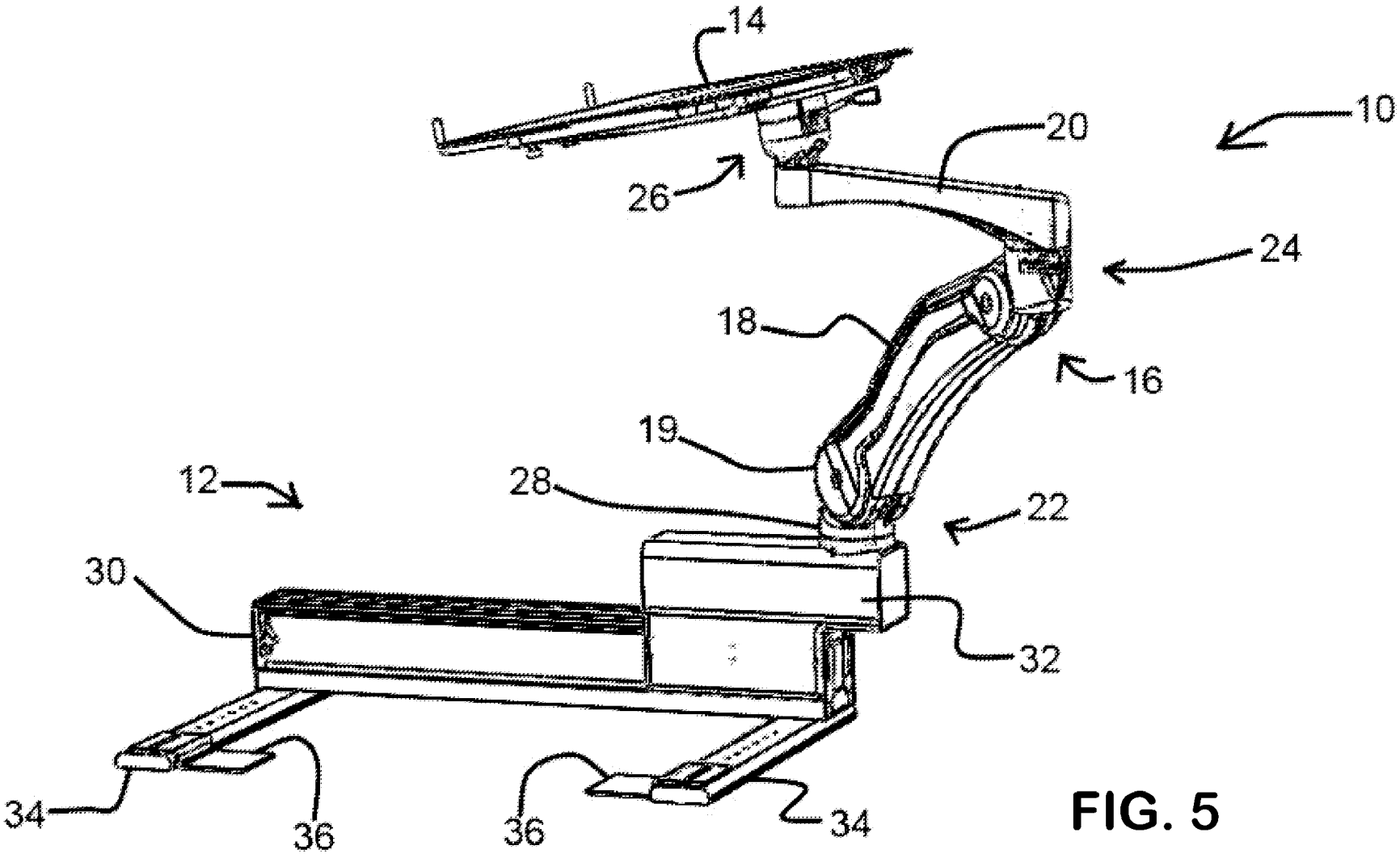
Figure 6:
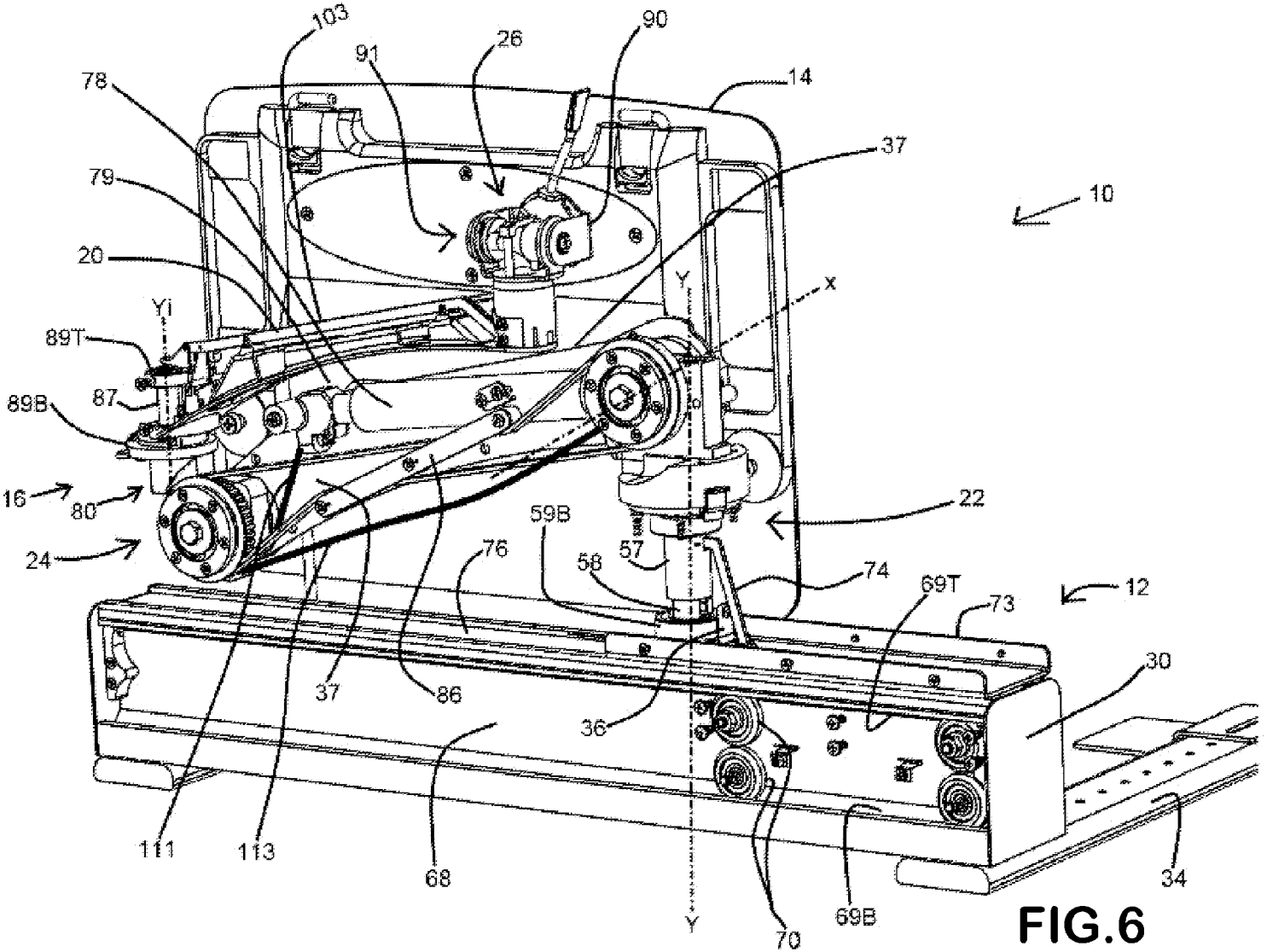
FIG. 6 is a perspective view of the support table device of FIG. 1, being partially disassembled to reveal the internal components thereof.

FIGS. 1, 2 and 6 show the table device 10 in a stowed or folded position and FIGS. 3 to 5 show the table 10 in a deployed or unfolded position. The table 10 includes a base 12, a table member 14 and an articulating arm 16 mounted there between.

The arm 16 includes a proximal arm segment 18 and a distal segment 20. The arm 16 includes a bottom joint 22, a median joint 24 and top joint 26. Joint 22 is formed by the bottom end 19 of the proximal arm segment 18 being pivotally mounted to a platform 28 pivotally mounted to the base 12.

The base 12 includes a longitudinal member or beam 30 with a movable member or carrier 32. The beam is mounted on elongated feet supports 34. The feet support 34 includes receiving elements 35 providing for mounting the first elongate element 32 along the length thereof as well as stabilizers 36. As will be described herein, the feet element can be positioned beneath a couch or other furniture.

With respect to FIGS. 6, 7, 8 and 9, the joint 22 will now be described.

With particular reference to FIG. 6, joint 22 provides for the arm segment 18 to pivot about a horizontal axis x and a vertical axis y, thereby providing a universal joint.

Figure 8:
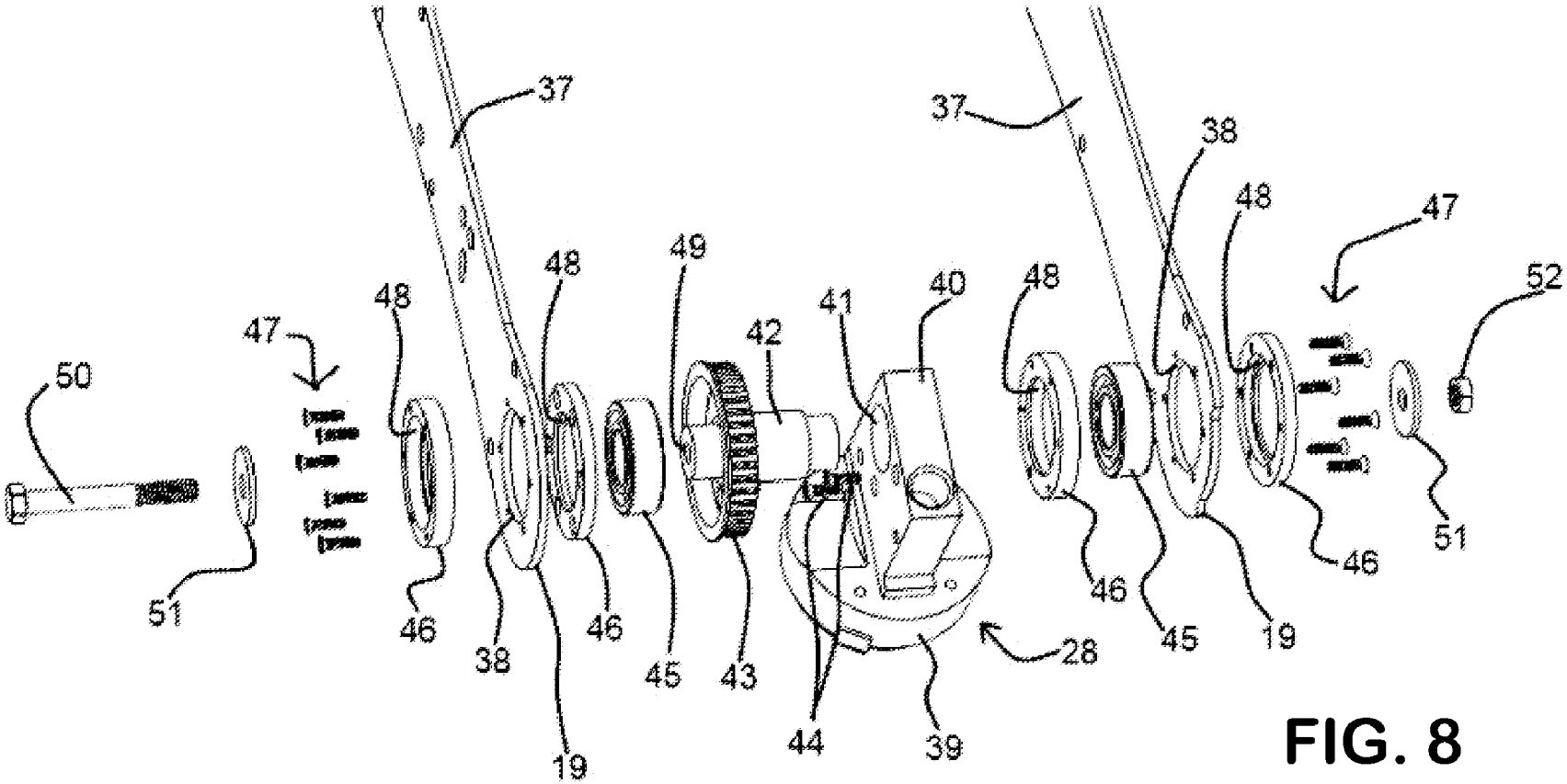
FIG. 8 is an exploded perspective view of the horizontal pivot assembly of the joint between the proximal arm segment and the base of the support table device of FIG. 1.

With particular reference to FIGS. 6 and 8, movement of the arm segment 18 about the horizontal x-axis will now be described. The arm segment 18 includes a pair of arm plaques 37 having respective apertures 38 at end 19. The platform 28 includes a circular base portion 39 as well as a plate 40 extending therefrom. The plate 40 includes an axial hole 41 for receiving an axle 42 extending from a gear 43. The gear 43 is fixed onto plate 40 via fasteners 44 and does not rotate. The axle 42 carries a pair of bearings 45 at each side of the plate 40. The arm plaques 37 are assembled with circular support plates 46, mounted at each side thereof via fasteners 47, and having apertures 48 which are aligned with apertures 38 for receiving the bearings 45 at each side of the plate 40. The axle 42 includes a bore 49 for receiving bolt 50 that is inserted through washers 51 at each side of the plate 40 and locked by a nut 52. In this way, the arm plaques rotate about the axle 42 via bearings 45.

Figure 9:
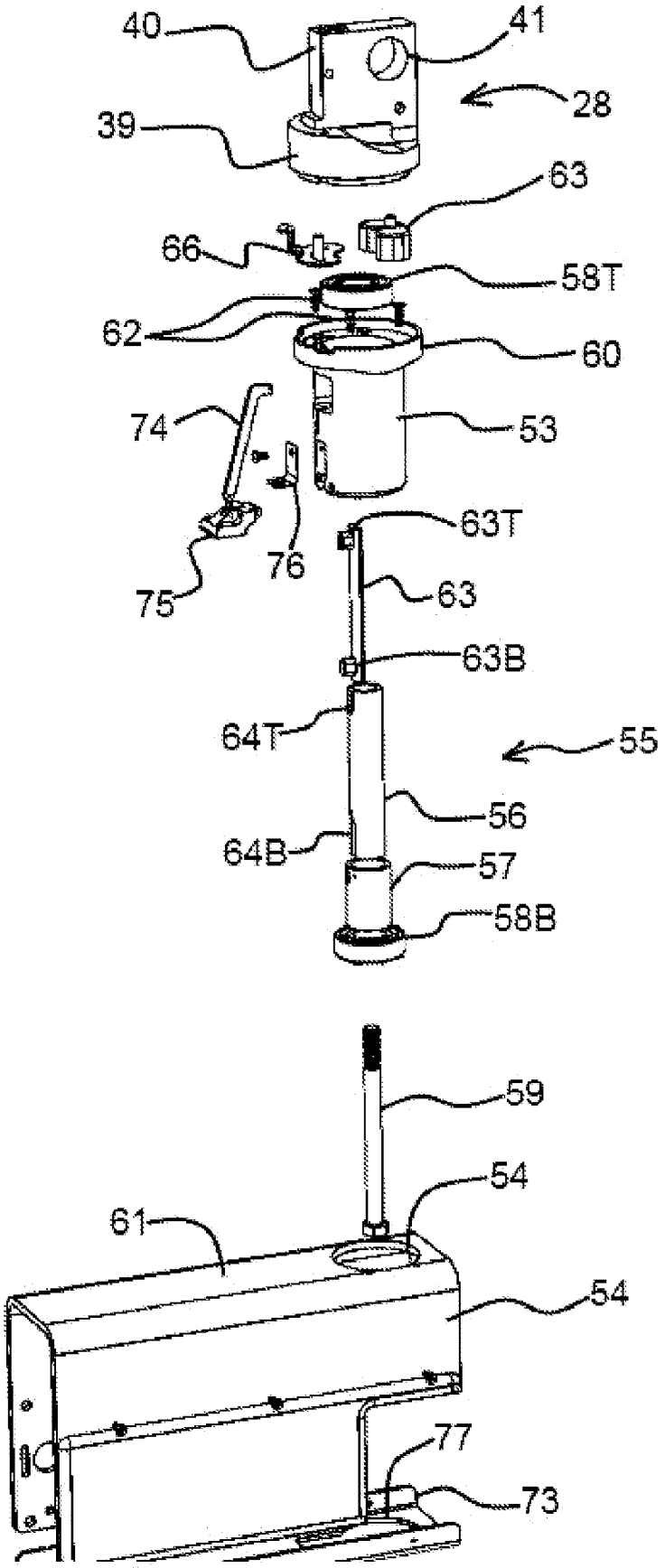
FIG. 9 is an exploded perspective view of the vertical pivot assembly of the joint between the proximal arm segment and the base of the support table device of FIG. 1.

With particular reference to FIGS. 6 and 9, movement of the arm segment 18 about the vertical y axis will now be described. The circular base portion 39 of the platform 28 is mounted to a sleeve 53 via an opening 54 though the carrier 32. The sleeve 53 houses a pivot assembly 55 which provides for the platform 28 to pivot about the vertical y-axis. More particularly, the pivot assembly 55 includes a shaft 56 fitted through a sleeve 57 and carrying top and bottom bearings 58T and 58B, respectively, all of which are housed within the sleeve 53. A bolt 59 fastens the shaft 56 to portion 39 of the platform 28. The sleeve 53 includes a larger top portion 60 that is fastened to the top side 61 of the carrier 32 about the opening 54 via fasteners 62. A stopper stem 63 is mounted within the shaft 56 for acting the bearings 58T and 58B via stoppers 63T and 63B which protrude from slits 64T and 64B formed on the shaft 56. An additional stopper 65 which also acts on the bearing 58T. A further stopper 66 limits fitted within portion 60 of the sleeve 53 limits the pivotal movement of the shaft 56 within a pre-determined angle. In this way, the arm segment 18 can only move from left to right within a predetermined distance. As such, the pivot assembly 55 provides for allowing the platform 28, which carries the arm segment 18, to pivot about the y-axis defined by the shaft 56 and bolt 59.

As shown in FIGS. 1 and 2, the carrier 32 is provided to slide along the length of the beam 30.

Figure 7:
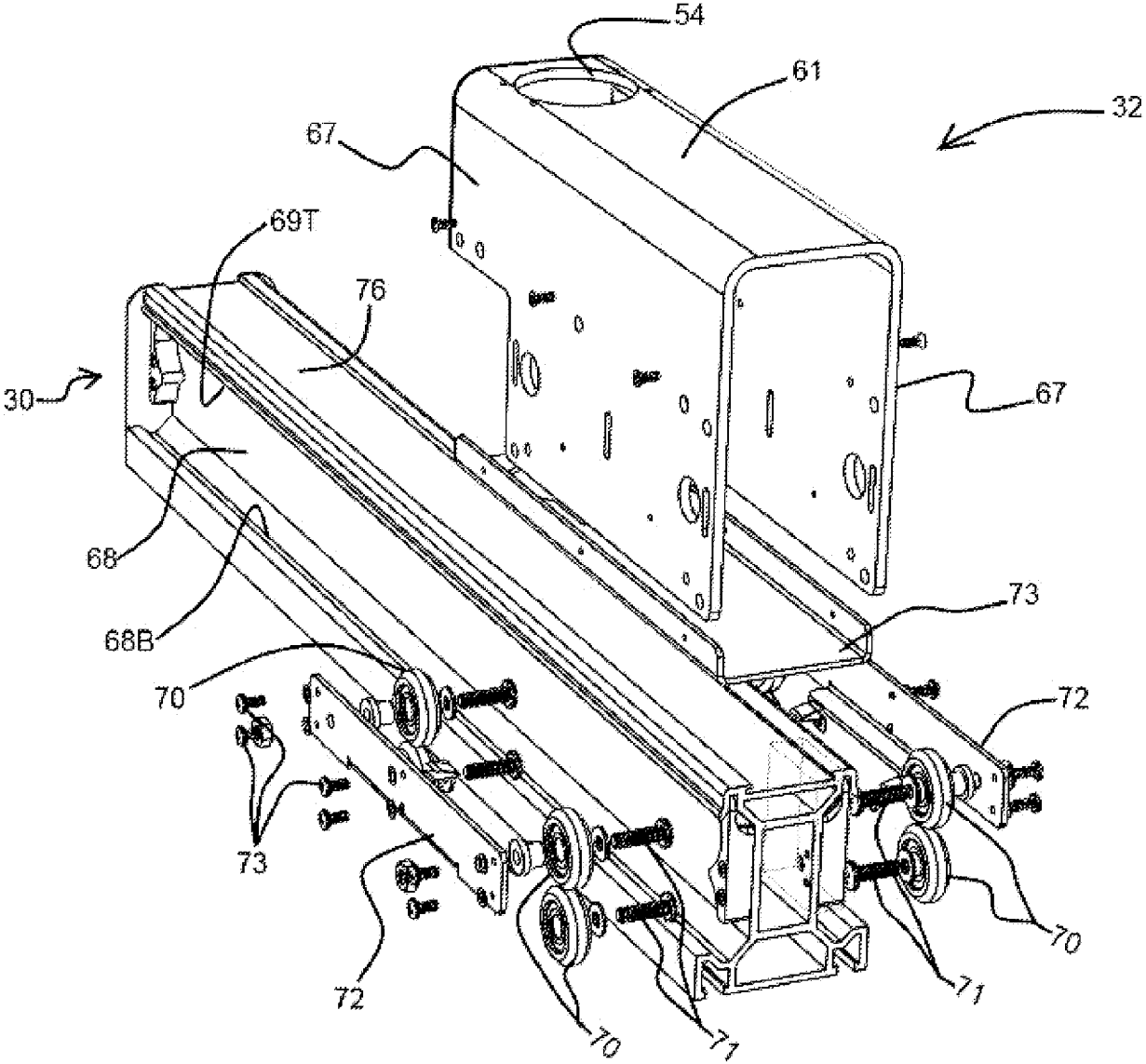
FIG. 7 is an exploded perspective view of the base of the support table device of FIG. 1.

Turning to FIG. 7, the carrier 32 includes side a pair of flaps 67 extending from the top side 61 so as top be respectively positioned adjacent the lateral sides 68 of the beam 30. Each lateral side 68 comprises an intrusion within the beam 30 defining top and bottom rails 69T and 69B, respectively. The flaps 67 carry rollers 70 mounted to axles 71 which are mounted to a support panels 72 that are in turn fastened to the flaps 67 via fasteners 72. As such, the rollers 70 roll along rails 69T and 69B. A rigid plate 73 is mounted to the carrier 32 between flaps the flaps 67 to add support thereto.

With respect to FIGS. 6 and 9, a linkage 74 mounted to the sleeves 53 and 57 and to stem 63 includes a stopper or breaking element 75 supported by tab 76 mounted to the sleeve 53 acts on the top side 76 of the beam 30 via opening 77 formed within plate 73 so as to stop the carrier 32 from sliding along the beam 30.

Turning to FIG. 6, the arm segment 18 also carries a double acting air-cylinder 78 on its plaque 37 including a push rod 79 which assists the arm 18 in moving upwards and downwards when pivoting about the x-axis. As the arm segment 18 moves upwards, the rod 79 inside the air-cylinder 78 extends and the air-cylinder 79 uses an inflow of air to help push the rod 79 along thereby adding extra force to the rising arm segment 18. When the air segment is moved downwards, the air flows backwards out of the air-cylinder 79 and the rod distends pulling the arm segment 18 down.

With respect to FIGS. 6, 10 and 11, the joint 24 will now be described.

The arm plaques 37 of the arm segment 18 respective apertures 33 at their ends 17. A platform member 80 includes a circular base portion 81 having a hole 82 as well as a plate 83 extending therefrom including an axial hole 84 for receiving an axle 42' extending from a gear 43'. The gear 43' rotatably mounted to plate 83. The axle 42' carries a pair of bearings 45' at each side of the plate 84. The arm plaques 37 are assembled with circular support plates 46', mounted at each side thereof via fasteners 47', and having apertures 48' which are aligned with apertures 33 for receiving the bearings 45' at each side of the plate 83. The axle 42' includes a bore 49' for receiving bolt 50' that is inserted through washers 51' at each side of the plate 83 and locked by a nut 52 and housed by housing wall 84. In this way, the gear 43' rotates relative to the platform member 80 which is maintained in the vertical position as shown in FIG. 10.

Figure 10:
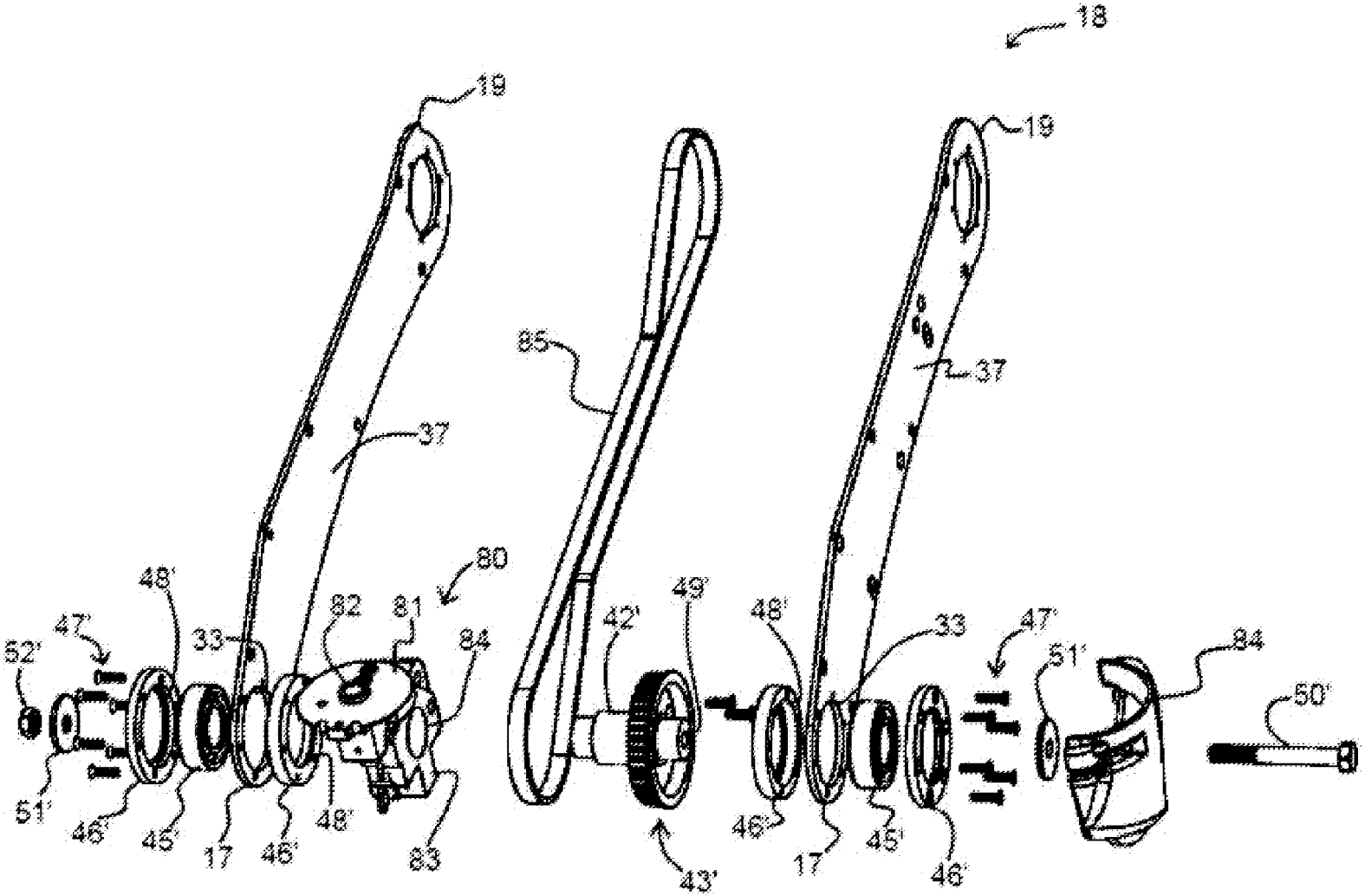
FIG. 10 is an exploded perspective view of the joint between the proximal and distal arm segments of the support table device of FIG. 1.

With particular reference to FIGS. 6 and 10 a conveyor element 85 such as a belt or chain is mounted to the rotatable gear 43' and the fixed gear 43, a tensioner 86 is also mounted the conveyor element 85. The gears 43, 43', the conveyor element 85 and the tensioner 86 provide for maintaining the arm segment 18 in position and for rotating the gear 43' during the upward or downward movement of the arm segment 18 relative to the platform member 80 so that the platform 80 is maintained in the vertical position. Since, the distal arm segment 20 is mounted to the platform 80 it can thus maintain its generally parallel position relative to the ground as the proximal arm segment 18 is moved upwardly or downwardly as is shown in FIGS. 3, 4 and 5.

Figure 11:
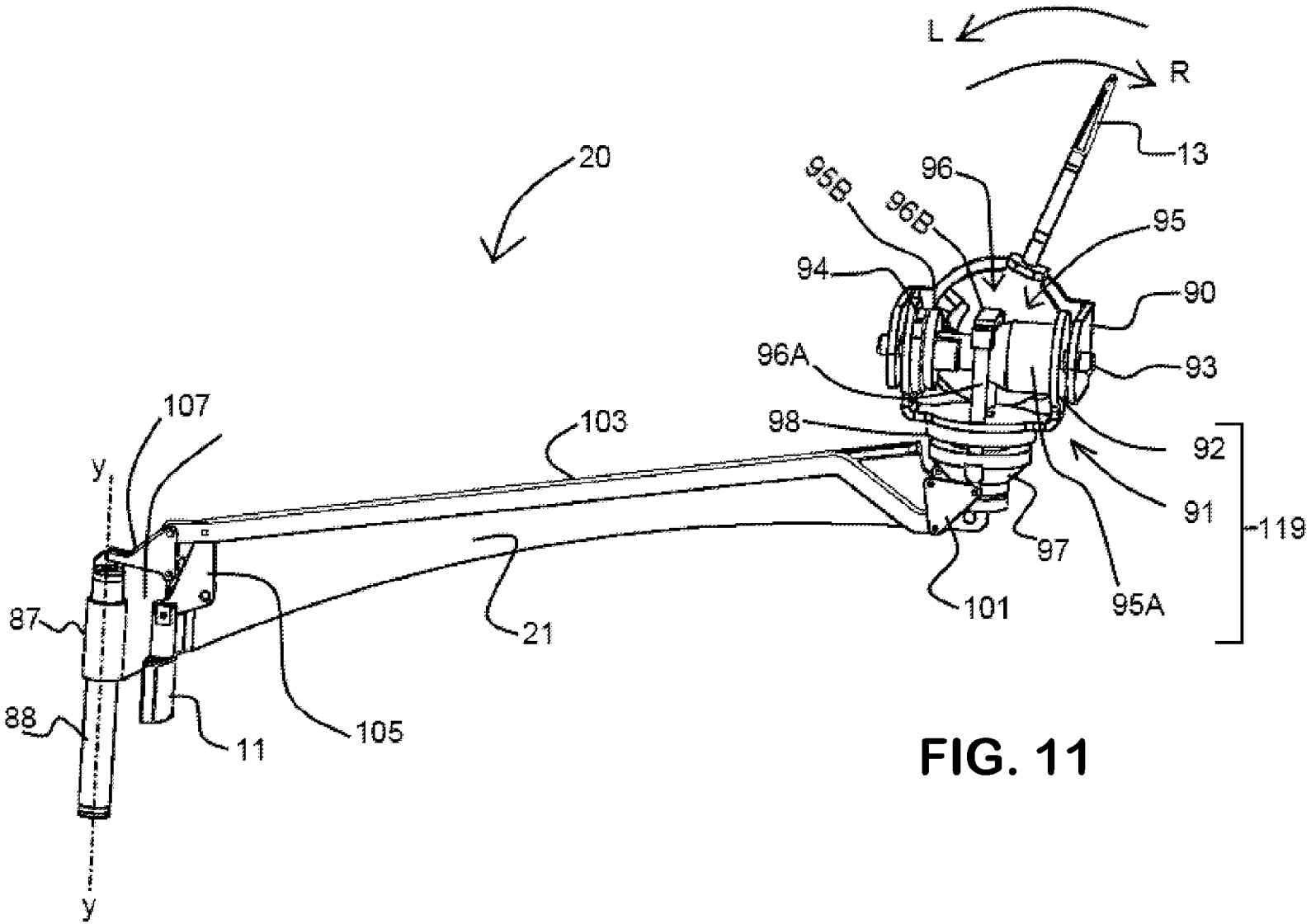
FIG. 11 is a lateral side view of a partially disassembled distal arm segment of the of the support table device of FIG. 1.

Turning to FIGS. 6 and 11, the distal arm segment 20 includes an arm plaque having a tubular shaft 87 at one end 23 mounted to a shaft 88 that is fitted within hole 82 of the platform member 80 (see FIG. 10). The tubular shaft 87 is circumscribed by top and bottom bearings 89T and 89B for rotation thereof, thereby allowing the plaque 21 (and thus the arm segment 20) to pivot in the left and right direction about the vertical y-axis defined by shaft 87. A stopper 11 depending from the arm plaque 21 acts on bearings 89T and 89B for stopping the shaft 87 from pivoting.

Figure 12:
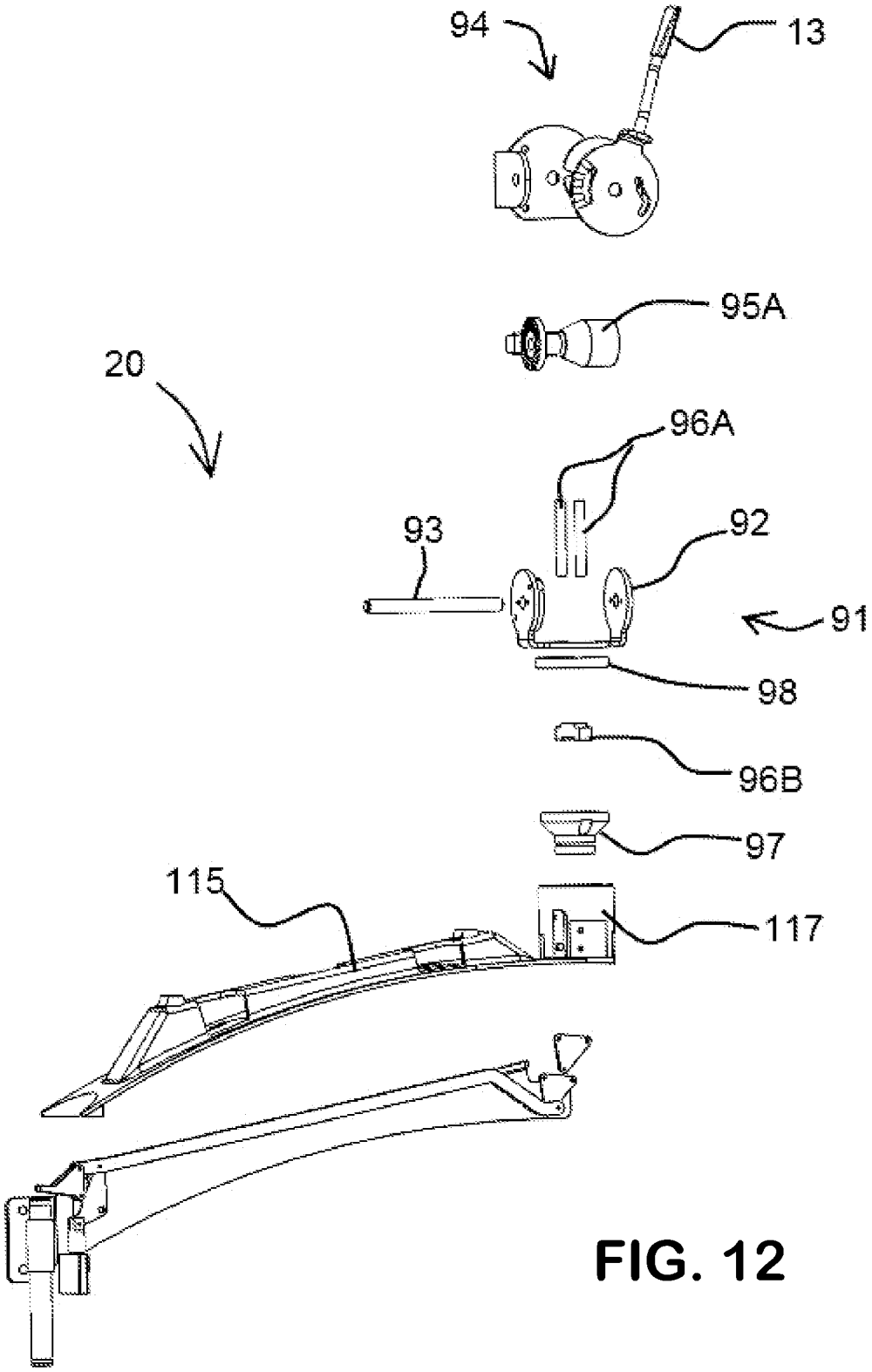
FIG. 12 is a lateral side exploded view of the distal arm segment of the of the support table device of FIG. 1.

With particular reference to FIGS. 6, 11 and 12 the joint 26 will now be described.

The underside of the table member 14 includes bracket 90 pivotally mounted to a locking mechanism 91 and housed within housing 15 (see FIG. 1). The locking mechanism 91 includes a bracket 92 pivotally mounted to bracket 90 via pivot rod 93. A lever 13 protrudes from housing 15 and is contiguous to a control gears 94 for acting on a flexible and resilient member 95 positioned within the bracket 92 and receiving the rod 93 therethrough. A linking member 96 including a pair of rods 96A mounted to a top connector 96B, the rods 96A are mounted to a stopper member 97 via the bracket 92 and support plate 98.

The member 95 includes a generally frusto-conical main body 95A with a toothed disc 95B at one end thereof that mates with a corresponding toothed disc 98 when the lever is in the L direction (see FIG. 11) thereby blocking the tilting of the table member 14 relative to the arm segment 20.

With respect to FIGS. 6 and 11, the table device 10 includes a locking assembly for locking all the joints 22, 24 and 26 as well as the movement of the carrier 32. The previously described stoppers, 11, 63, 65 and 75 are all spring biased to abut elements 89T/89B, 58T/58B, 58T, and 61 as previously explained thereby stopping the pivoting of arm segments 20 and 18 as well as movement of carrier 32 along beam 30. The locking assembly provides for either disengaging the stoppers from the foregoing elements thus allowing pivoting and movement thereof or for allowing the biasing force to take effect and thus provide for the stoppers to engage the foregoing elements thereby locking the table device 10 in a given configuration.

More specifically, when moving the lever 13 towards the L direction shown in FIG. 11, the flexible member 95 the linking element 96 which lifts the stopper 97 (which acts as a break pad or damper) onto the plate 98 thereby allowing the movement of the bracket 90 about the pivot rod 93 thus providing for the table member 14 to pivot. The stopper 97 acts on a linking member 101 which lifts an longitudinal linking member 103 spanning the plaque 21, via linking member 105, thereby lifting the stopper 11 from the bearings 89T/89B thus allowing the arm segment 20 to pivot from left to right. The linking member 103 also lifts linking member 107 which lifts the shaft 88 pulling break cable 111 upwardly and releasing the air-cylinder 78 allowing the arm segment 18 to pivot about the horizontal x-axis. The shaft 88 also pulls on break cable 113 which pulls up stopper stem 63 allowing the arm segment 18 to pivot about the y-axis. The cable 113 also pulls up member 74 allowing the carrier 32 to slide along beam 30. When moving the lever 13 to the R direction flexible member 95 allows the linking member 96 to drop thereby allowing the aforementioned spring biasing force to take action and block the above elements as previously explained.

FIGS. 6 and 12, show that the arm segment 20 includes a support 115 including a housing 117 for housing section 119 of FIG. 11.

Figure 15:
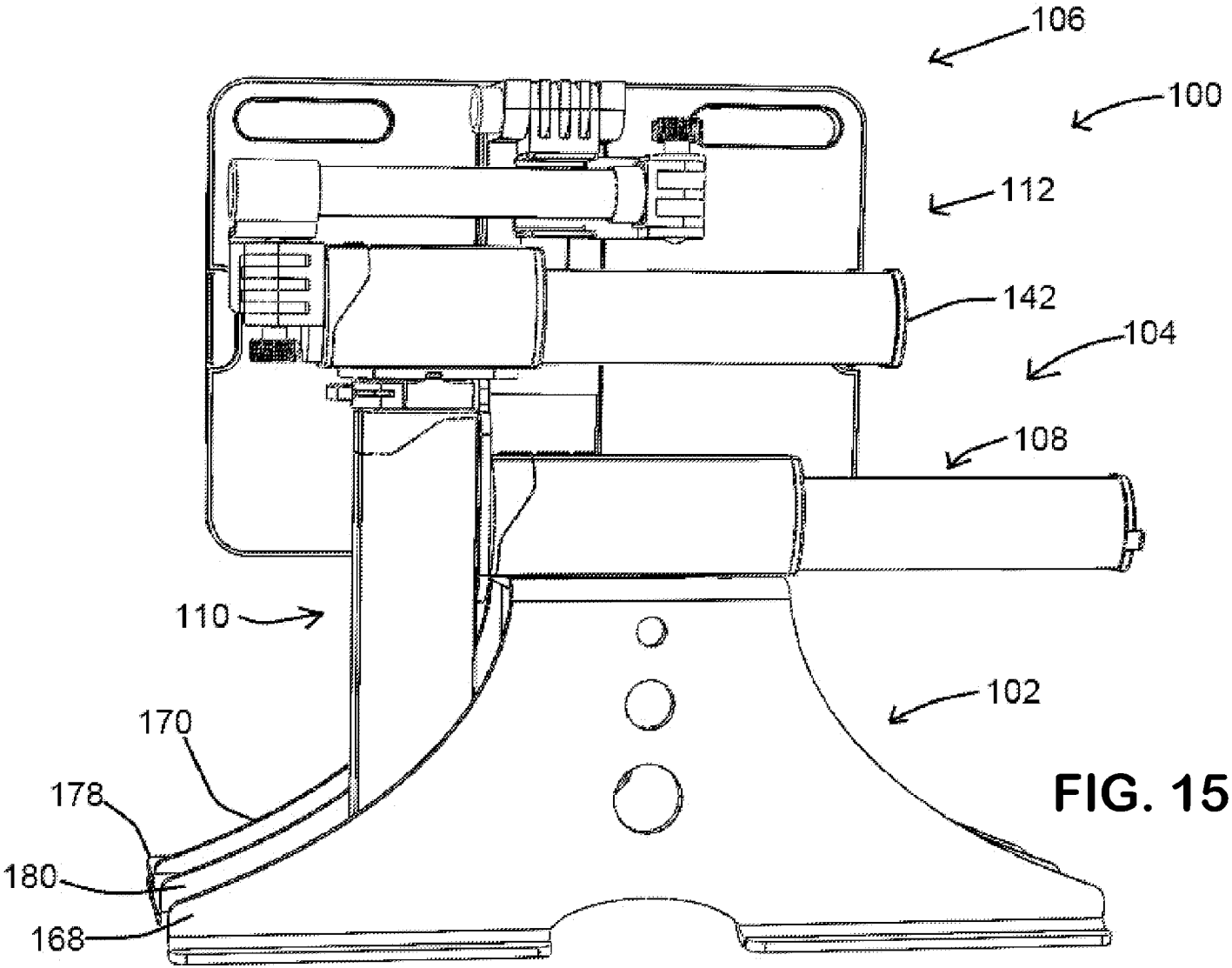
FIG. 15 is a perspective view of a support table device in a stowed position in accordance with another illustrative embodiment of the present invention.
Figure 16:
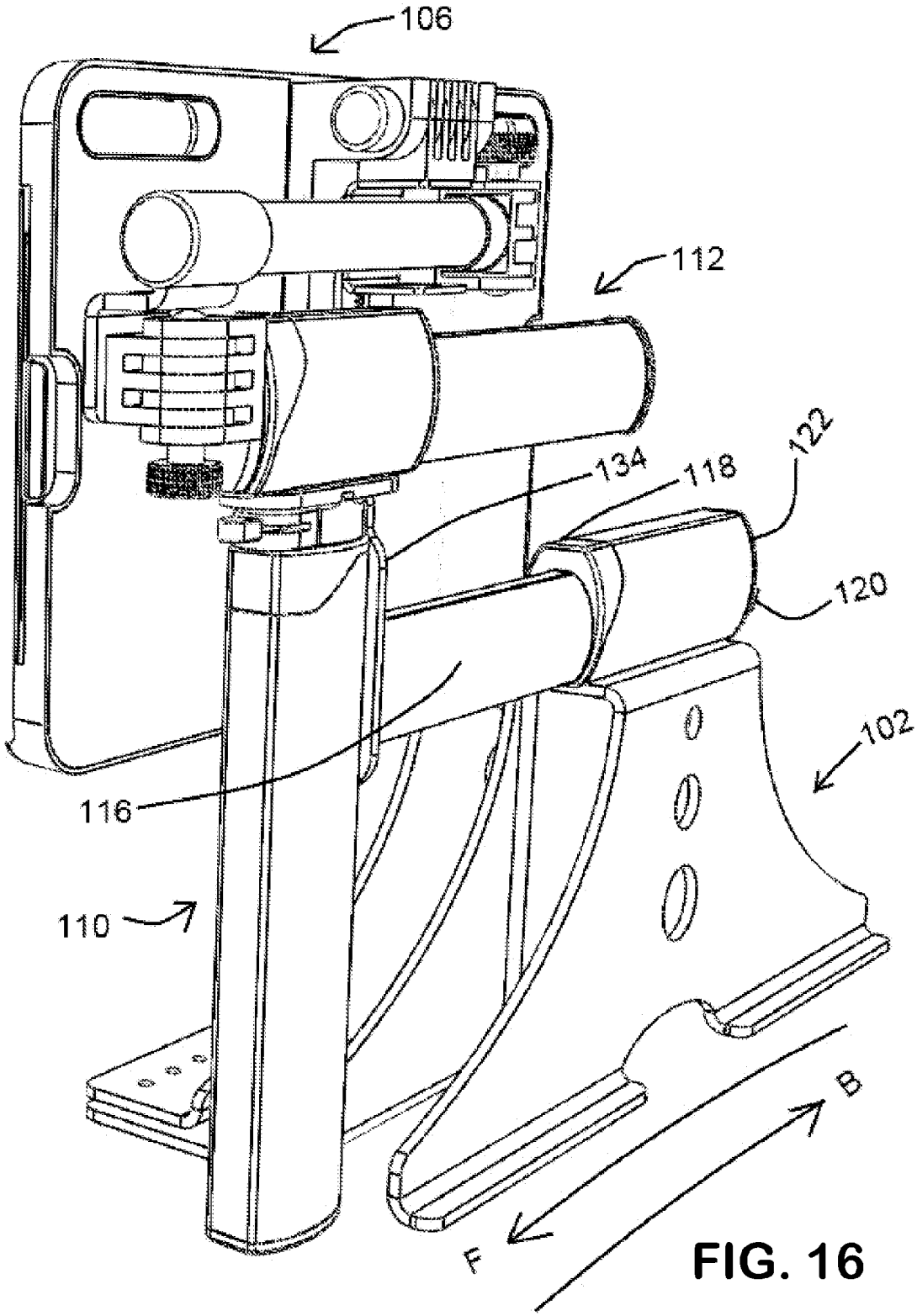
FIG. 16 is a perspective view of the support table device of FIG. 15 in a slightly extended position.

With respect to FIGS. 13 and 15, the arm segments 18 and 20 include clips 7 and passages 9 for passing a cable or wire W therethrough.

With respect to FIGS. 15 to 20 another illustrative embodiment of a support table generally denoted here as 100 will now be described so as to further exemplify the present invention.

The support table 100 includes a base 102, an articulating arm 104 and table member 106.

The articulating arm 104 includes three sections, namely a base section 108, a median section 110 and top section 112.

The base section 108 includes a base sleeve 114 mounted to the base member 102 and a base arm segment 116 slidably mounted to the sleeve 114 via its tubular opening 118. The arm segment 116 includes a free end having a stopper element 120 so that when sliding in the direction shown by arrow F its stopper element 120 abuts the rim 122 of the sleeve 108. The arm segment 116 includes at its other end a connector 124 for being connected to the median section 110.

Figure 17:
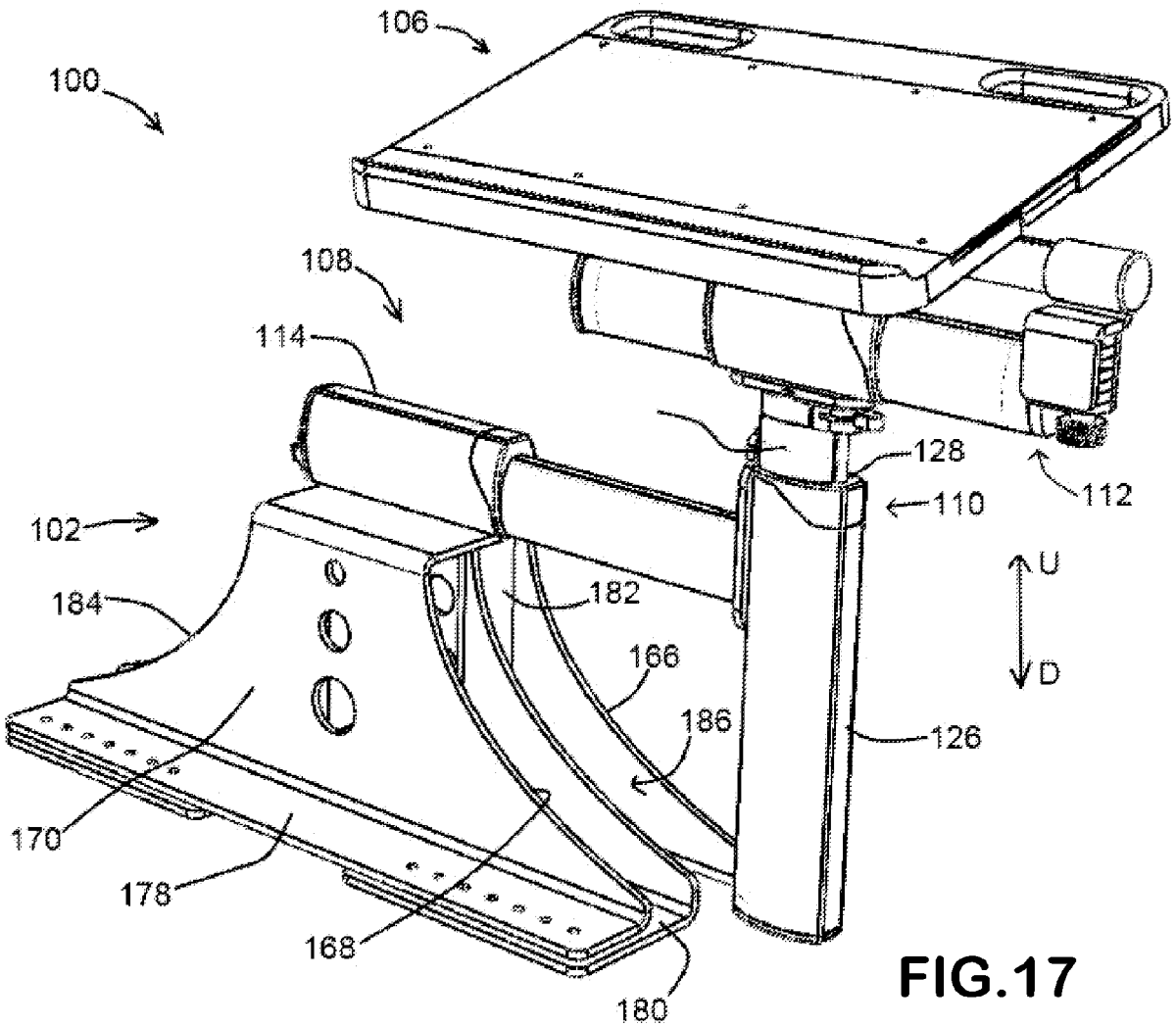
FIG. 17 is a perspective view of the support table device of FIG. 15 from an opposite side view in a partially extended position.
Figure 18:
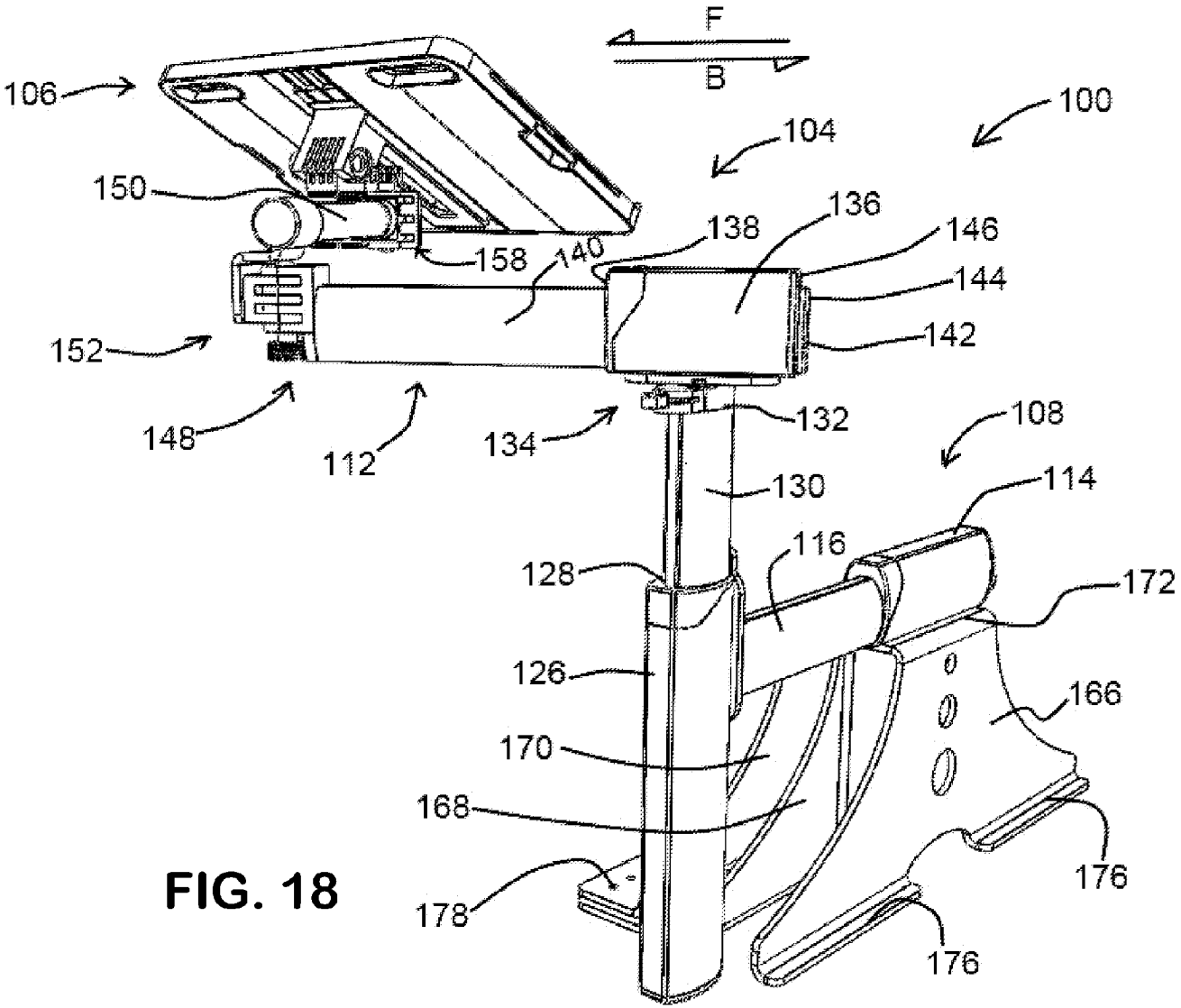
FIG. 18 is a front perspective view of the support table device of FIG. 15 in a fully extended position.
Figure 19:
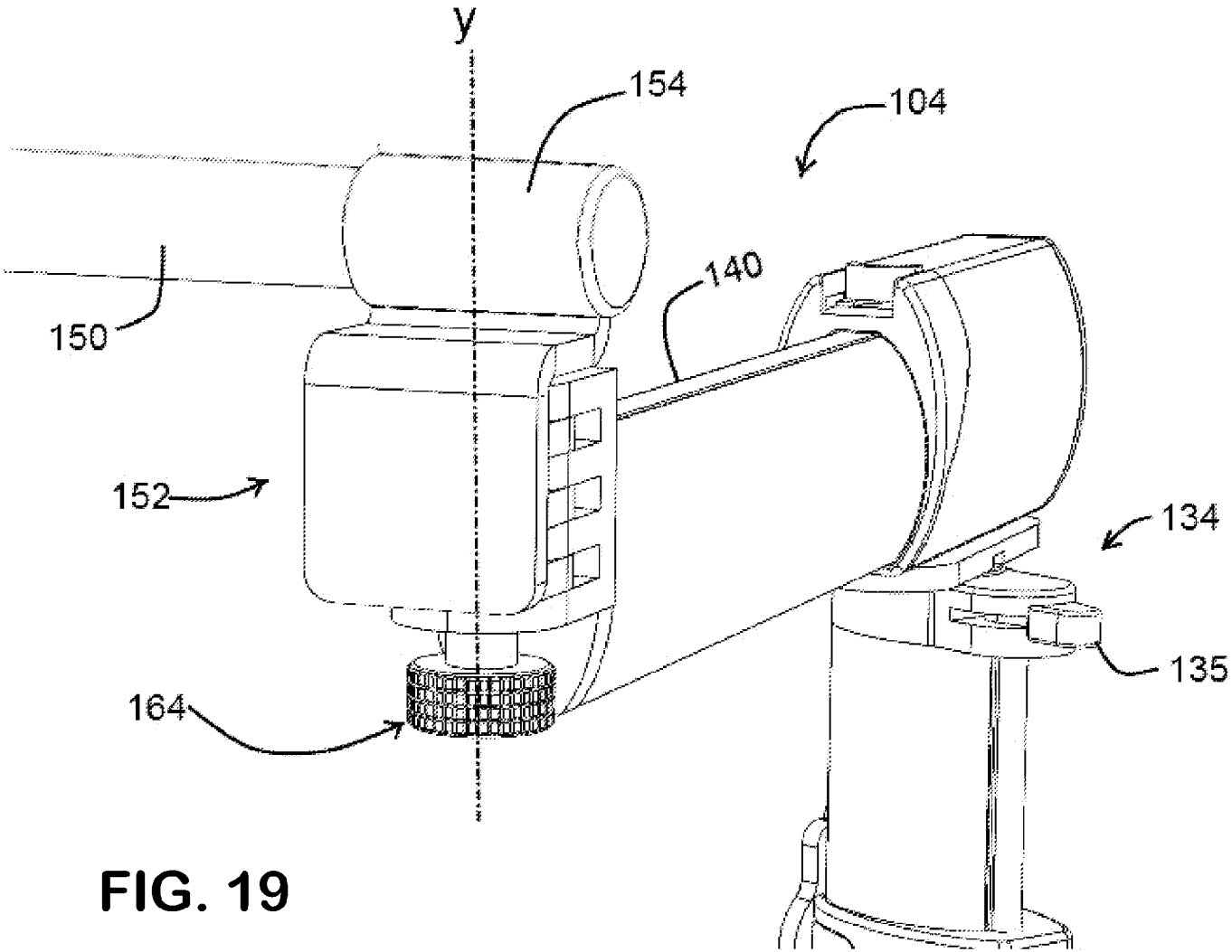
FIG. 19 is a close-up perspective e view of the articulating arm of the support table device of FIG. 15.

The median section 110 includes a median vertical sleeve 126 for slidably receiving via its tubular opening 128 a median vertical arm segment 130. The arm segment 130 is slidably movable within the sleeve 126 in an upwards and downwards position as shown by arrow UID in FIG. 17. The sleeve 126 is connected to the base arm segment 116 via the connector 124. The median arm segment 130 includes a bottom end (not shown) that is configured so as not to be disengaged from the sleeve 126 when extended therefrom. As shown in FIG. 18, the top end 132 of the arm segment 130 is pivotally connected to the top section 112 via a pivot assembly 134.

The top section 104 includes a top sleeve 136 defining a tubular opening 138 for slidably receiving therein a top arm segment 140 that is movable as shown by arrows F and B in FIG. 18 through the sleeve 136. The arm segment 140 includes a free end 142 having a stopper 144 for abutting the rim 146 of the sleeve 136 when extended in the F direction. The top arm segment 140 also includes an opposite end 148 which is mounted to an arm extension 150 via a pivot assembly 152. With respect to FIG. 19, the arm extension 150 includes one end 154 mounted to the top arm segment 140 via the pivot assembly 152 and another end 156 being mounted to a pivot assembly 158 which is connected to the table member 106 via a connector 160.

The pivot assembly 158 includes a vertical pivot 158A for allowing the table 106 to pivot about a vertical y-axis via pivot 158A and a horizontal x-axis via pivot 158B.

The arm segment 116 can be slidably positioned along different positions via the sleeve 114. The vertical arm segment 130 can also be held in position at different positions along sleeve 126 via the use of a clamp member for example. The sleeve 136 can rotate about the arm segment 130 via the pivot assembly 134. The arm segment 140 can be placed at different positions through the sleeve 136.

Pivot assembly 152 provides for the arm extension 150 to rotate about the y-axis. Pivot assemblies 134, 158 and 164 define joints and can be provided in a variety of configurations, such as hinge assemblies. The pivot assembly or joint 134 can be locked into position via a locking lever 135. The pivot assemblies or joints 158 and 164 can be adjusted or locked into position via screw members 159, 161 and 164.

The base member 102 has a generally triangular shaped body with three spaced apart panels 166, 168 and 170 of similar configuration all of which meet at a top flat summit or face 172 on which the sleeve 114 is fixedly mounted to. In an alternative embodiment the sleeve 114 can be pivotally mounted to the top face 172.

Panels 166 and 168 provide a clearance 174 for the sleeve 126 to be fitted therein. Panel 166 includes short feet elements 176 which provide stability. Panel 170 includes a larger and longer foot element 178 which provides stability and which can also fitted beneath a couch for example as shown in FIG. 15. FIG. 15 also shows that panel 168 also includes a foot element 180 that is positioned beneath the foot element 178 as such foot element 180 acts as a base platform (see also FIG. 17). FIG. 17 also shows that panels 168 and 166 form a wall 182 therebetween. Furthermore, panel 168 is shown in FIG. 17 not to be a complete contiguous wall but only a segmented wall. Of course, various other types of configurations can be contemplated. The foregoing only provides one particular aesthetic design. Again in this illustrated example only, the panels 168, 166 and 180 form concavely curved sides 184 and 186 adding to the aesthetic appreciation of the base 102.

With respect to FIGS. 21-26 a table support device 200 in accordance with another illustrative embodiment of the present invention will now be described.

Figure 21:
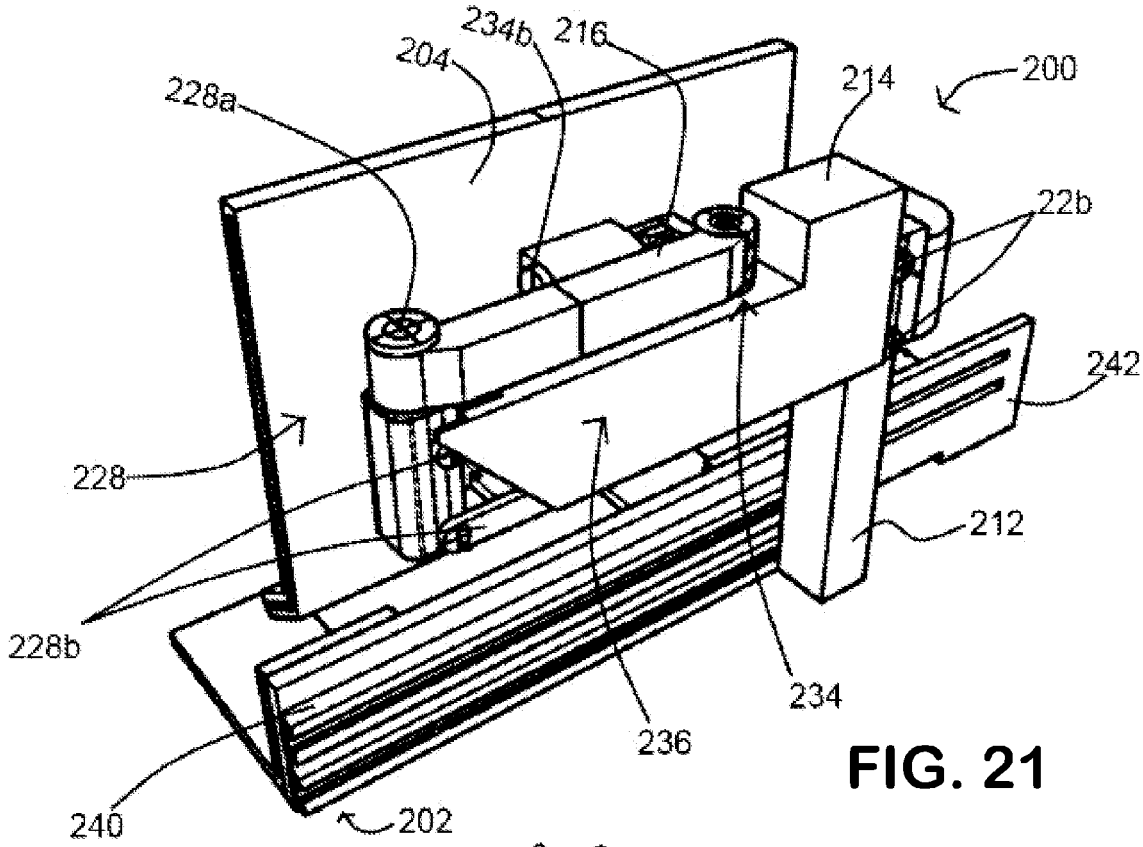
FIG. 21 is a side perspective view of the support table device in accordance with another illustrative embodiment of the present invention in a stowed position.
Figure 22:
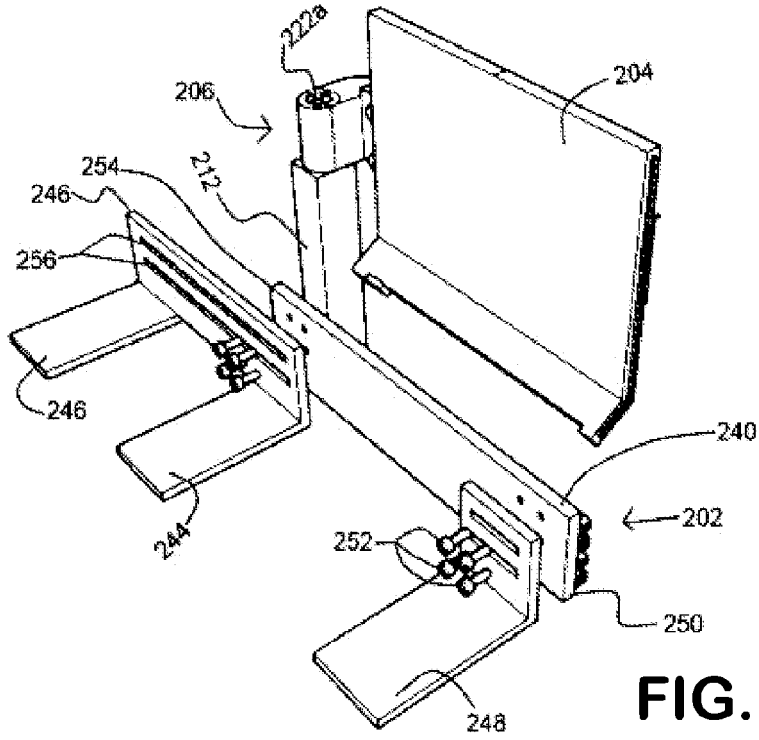
FIG. 22 is a side and rear front perspective view of the support table device of FIG. 21.

FIGS. 21 and 22 show the device 200 in a stowed or folded position including a base 202, a table member 204 and an articulating arm 206 mounted therebetween.

With respect to FIGS. 23 to 26, the device is shown in the deployed or unfolded position.

As will be explained herein, the articulating arm 206 can be retracted and expanded so as to provide for moving the device 200 from the stowed to the deployed positions. In this way and as better shown in FIG. 26, the articulating arm 206 is mounted at one end 208 thereof to the base 202 and at an opposite end 210 to the table member 204. Furthermore and with particular reference to FIGS. 23 to 26, the articulating arm 206 includes three arm sections or segments, namely a bottom arm section or post 212, a median arm section 214 and a top arm section 216. The bottom post 212 includes end 210 which is mounted to the base 202 while the opposite end 218 thereof is pivotally mounted to the bottom end 220 (thereby defining a joint) of the median arm section 214 via a joint or pivot assembly 222. The top end 124 of median arm section 214 is pivotally mounted to the bottom end 226 of arm section 116 via a joint or pivot assembly 228. Finally and with reference to FIG. 26, the top end 230 is pivotally mounted to the underside 232 of the table member 204 via a joint or pivot assembly 234.

Figure 23:
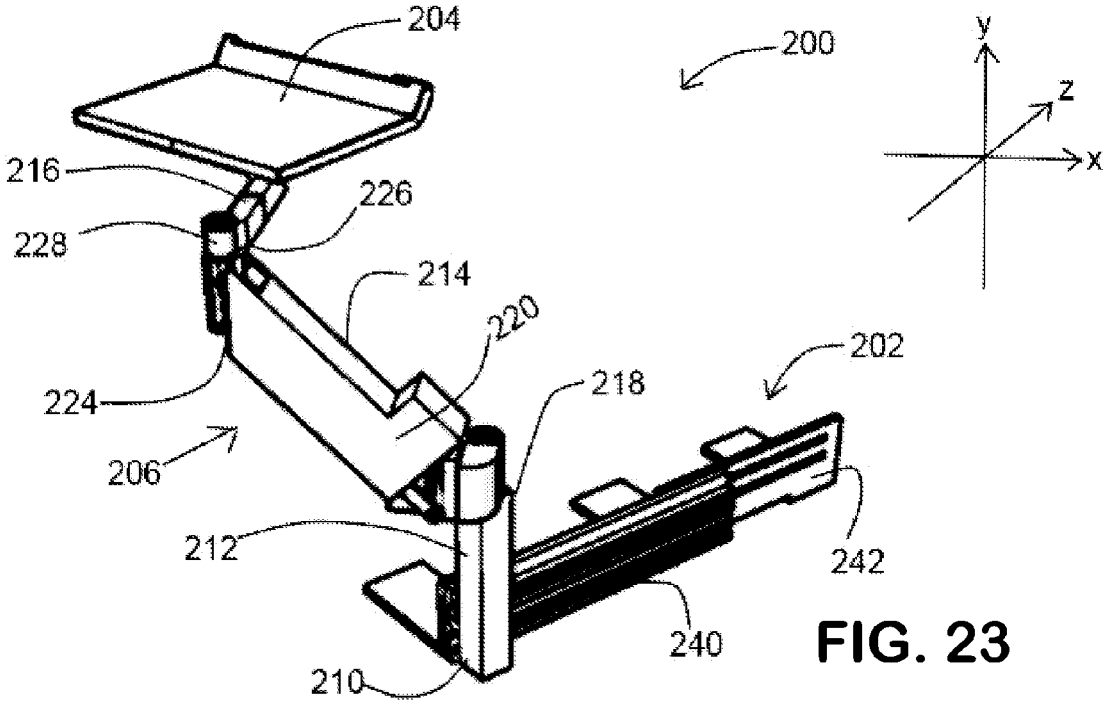
FIGS. 23, 24 and 25 are side and front perspective views of the support table device of FIG. 21 in a deployed position.

With general reference to FIG. 23 as regards to the axis of movement, the articulating arm 206 will now be described in operation. The pivot assemblies 222, 228 and 234 provide for the retracted and extended positions of the arm 206 which allows the device 200 from moving from the stowed position (shown in FIGS. 21 and 22) to the deployed position (shown in FIGS. 23 to 26). More specifically, pivot assembly 222 provides for the median arm section 214 to pivot about the Y axis via pivot member 222*a* (see FIGS. 22 and 26) and the Z axis for a predetermined angle via pivot member 222*b* (see FIGS. 21 and 26). Pivot assembly 228 provides for the top arm section 216 to pivot about the Y axis via pivot member 228*a* (see FIG. 21) and slightly about the Z axis via pivot members 228*b*. Finally, pivot assembly 234 provides for the table member 204 to pivot about the Y axis via pivot member 234*a* (see FIG. 21) and about the X axis via pivot member 234*b* (see FIG. 21).

Figure 26:
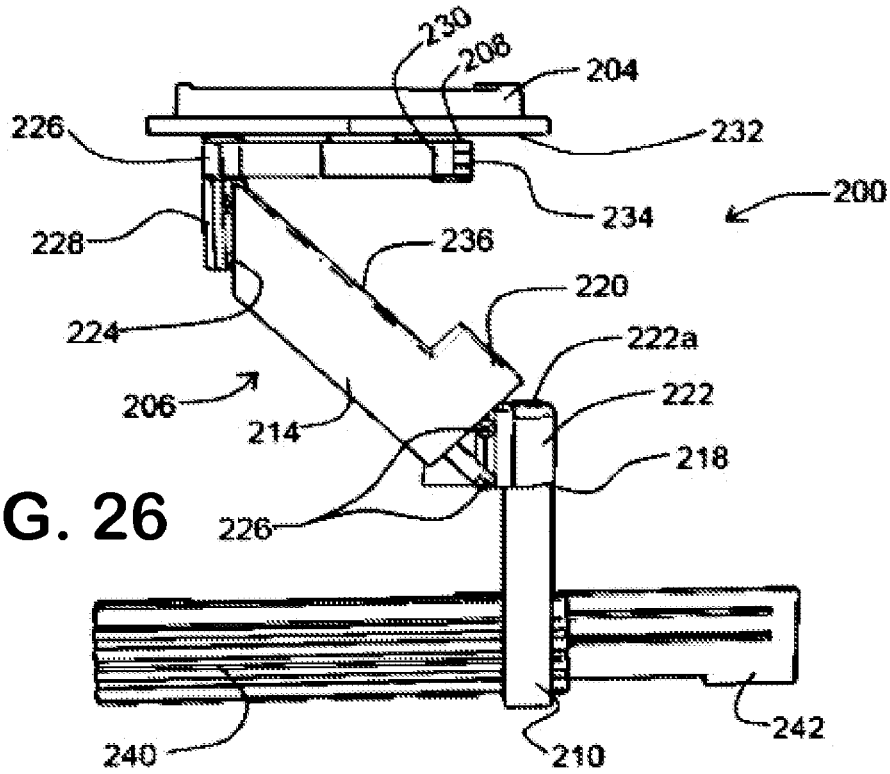
FIG. 26 is a rear elevational view of the support table device of FIG. 1 in a deployed position.

Referring to FIGS. 21 and 26, the median arm section 214 includes a recess 236 thereby providing a space for the top arm section 216 when the device 200 is in the folded position.

With reference to FIGS. 21 to 26, the base 202 will now be described. The base 202 includes two longitudinal base members 240 and 242. With particular reference to FIG. 22, base member 242 includes a pair of foot plates 244 and 246 at each longitudinal end thereof. An auxiliary foot plate 248 is also mountable along near one longitudinal end 250 of the base member 240 via fasteners 252. Both the bottom arm post 212 and the base member 242 are mountable near another longitudinal end 254 of the base member 240 via fasteners 252. It should be noted that the base member 242 may be mounted to the base member 240 at a variety of positions along its length by way of slots 256 thereby providing a desired length to the base 202. Furthermore, the base member 242 and the auxiliary foot plate 248 provide for a reversible installation by being mounted on their other side to the base member 240, with the foot plates 244, 246 and 248 pointing in a direction opposite the one shown in FIG. 22 for example.

Figure 24:
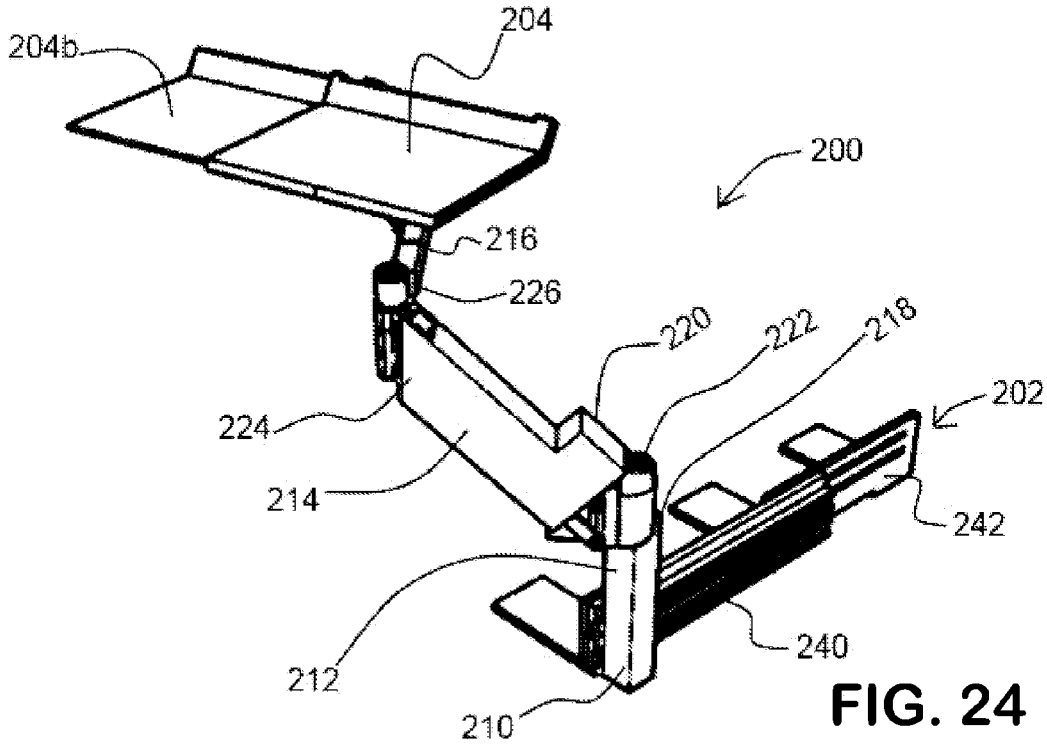
Figure 25:
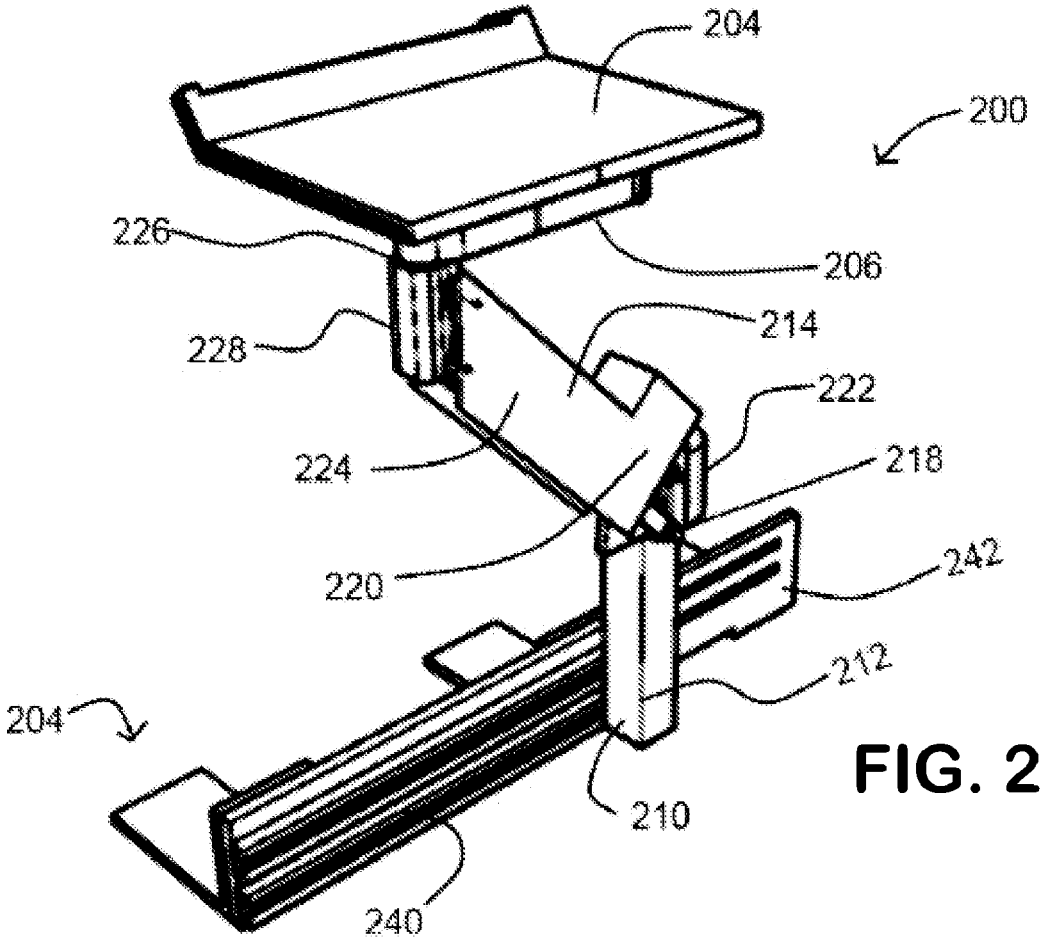

With reference to FIG. 24, the table member 204 may also include an auxiliary table member 204*b* slidably mounted thereto, thereby providing for selectively widening the support space provided by table member 204.

Figure 27:
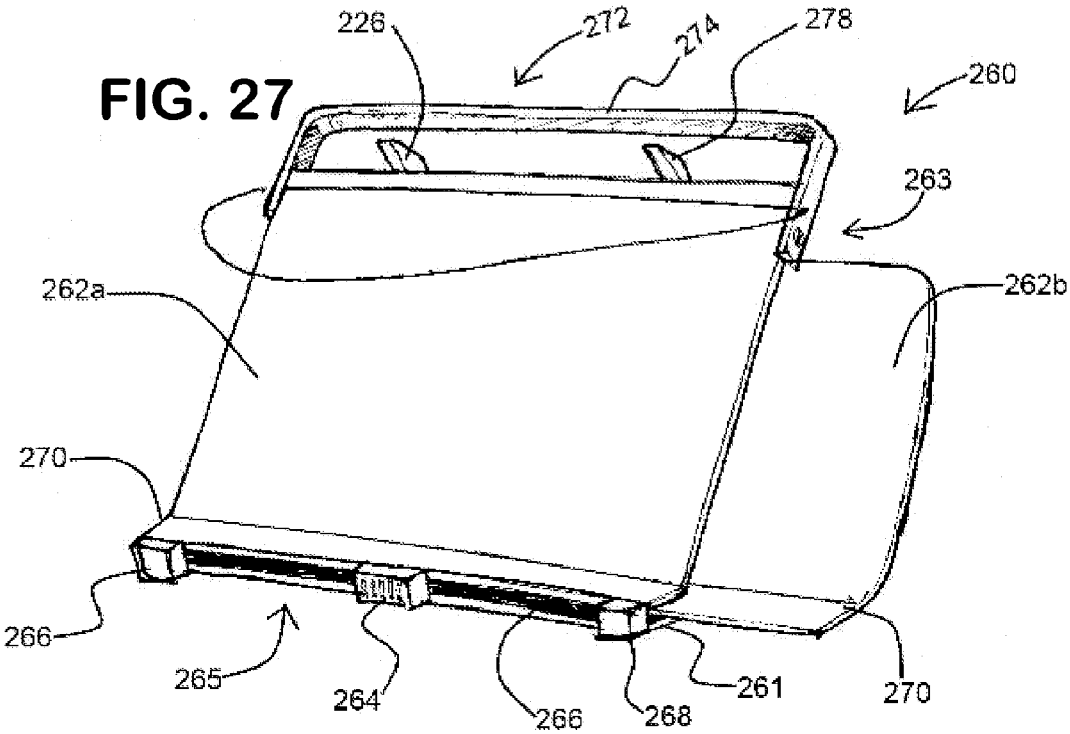
FIG. 27 is front perspective view of a table member for the support table devices of the present invention in accordance with a particular illustrative embodiment thereof.
Figure 28:
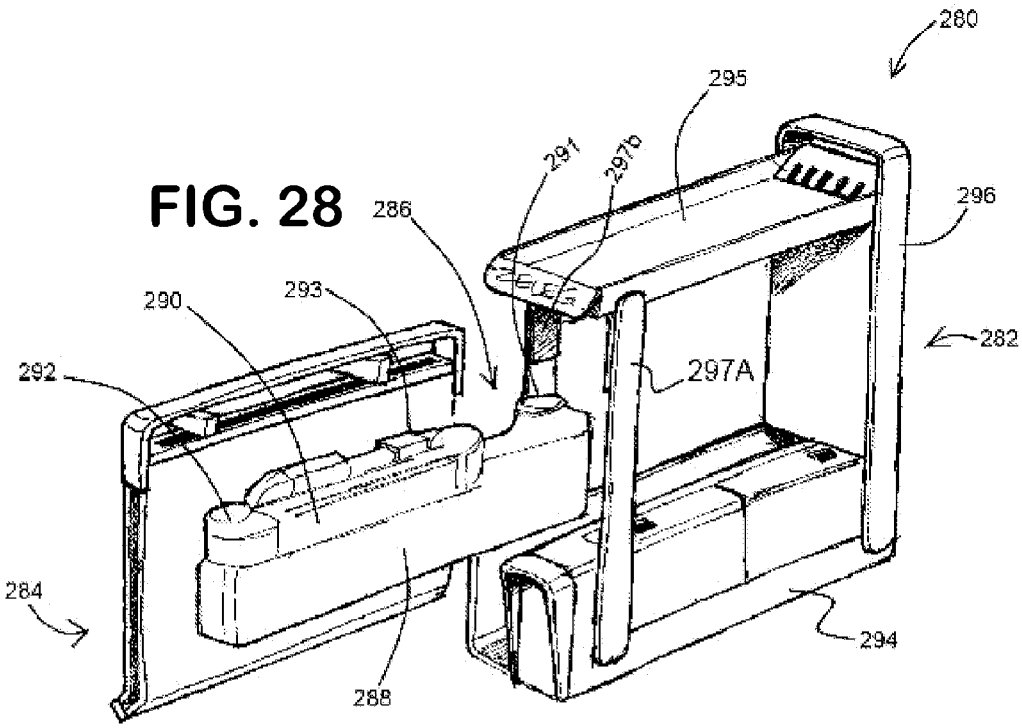
FIG. 28 is a side perspective view of the support table device in accordance with another illustrative embodiment of the present invention in a partially deployed position.

FIG. 27 shows a table member 260 in accordance with a particular illustrative embodiment.

The table member 260 includes a principal table element 262*a* and an auxiliary table element 262*b*. The auxiliary table element 262*b* is slidably mounted to the principal table element 262*a* so as to be retractable within and outwardly extendable from a longitudinal opening 261 at the lateral side 263 of the table element 262*a*. A cursor 264 mounted at the front side 265 of the principal table element 262*a* and is used to reciprocally move the auxiliary table element 262*b* between the inward and outward positions when being moved along a longitudinal slot 266 formed at the front side 265 of the table element 262*a*. A pair of end stoppers 266 and 268 are mounted at the longitudinal ends of the slot 266 in order to stop cursor 264 during movement thereof. Hence, moving the cursor 264 to end stopper 366 retracts the table member 262*b*, while moving the cursor 264 to end stopper 268 extracts the table member 262*b*.

The front side 265 of the table 260 also includes an upwardly curved portion 270 which may support a portable device such as a portable computer (i.e. laptop) or other articles. The end stoppers 266 and 268 may also be used as support elements for a portable device placed on table element 262*a*.

The top side 272 of table element 1040*a* includes a bracket member 274 which can be pivotally mounted to the table element 1040*a*. The bracket member 1054 provides a space for a pair of rear adjustable stoppers 276 and 278 which can be used to again support a portable device positioned on table 262*a*.

FIG. 27 illustrates a table support device 280 in accordance with a further illustrative embodiment of the present invention.

The device 280 includes a base 282, a table member 284 and an articulating arm 286. The articulating arm 286 includes a bottom arm or post-section (not shown), a median arm section 288 and a top arm section 290 that is pivotally mounted to the table member 284. The median arm section 288 is mounted to the post-member via a pivot assembly 291 and to the top arm section 216 via a pivot assembly 292. The top arm section 290 is mounted to the table member 284 via pivot assembly 293. The foregoing pivot assemblies or joints 291, 292 and 293 provide arm 286 and the table member 284 to be articulated between stowed and deployed positions as explained herein. The base 282 includes a bottom longitudinal member 294, a top longitudinal member 295, a first vertical member 296 at one end of both the longitudinal members 294 and 295 and a second pair of vertical members 297*a* and 297*b* near the other ends of the longitudinal members 294 and 295. In this way, the base 282 provides a housing for the articulating arm 286 as well as the table member 284. The housing or storage compartment can be closed by way of sliding doors. In this way, the base 282 can include a storage compartment, with sliding doors, for a power bar, chargers and laptop converters, With reference to FIGS. 29 to 31 a support table device 300 will now be described in accordance with another illustrative embodiment of the present invention.

The device 300 includes a base 302, a table member 304 and an articulating arm 306.

Figure 29:
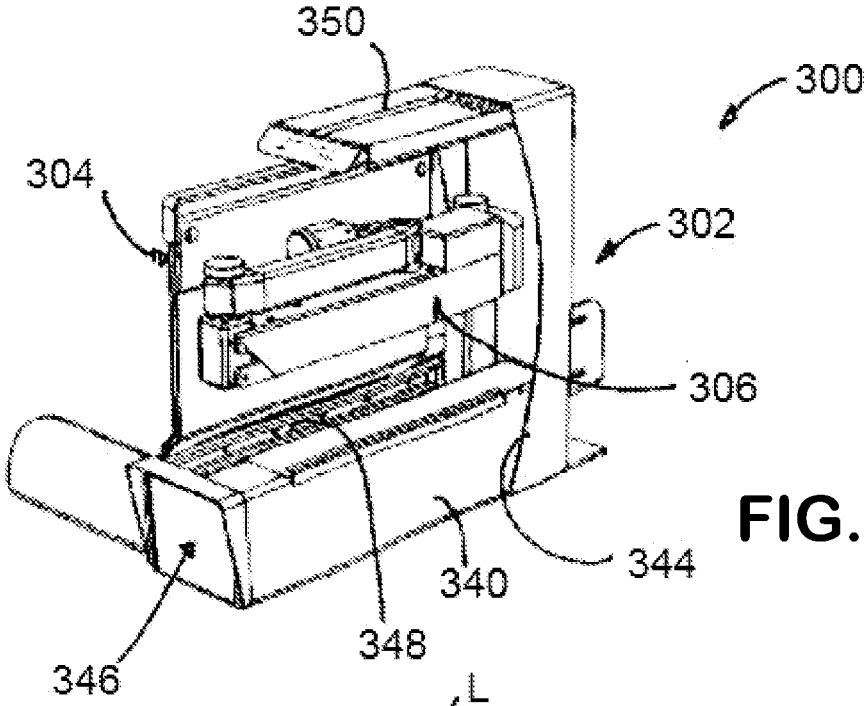
FIG. 29 is a side and front perspective view of the support table device in accordance with a further illustrative embodiment of the present invention in a stowed position.
Figure 30:
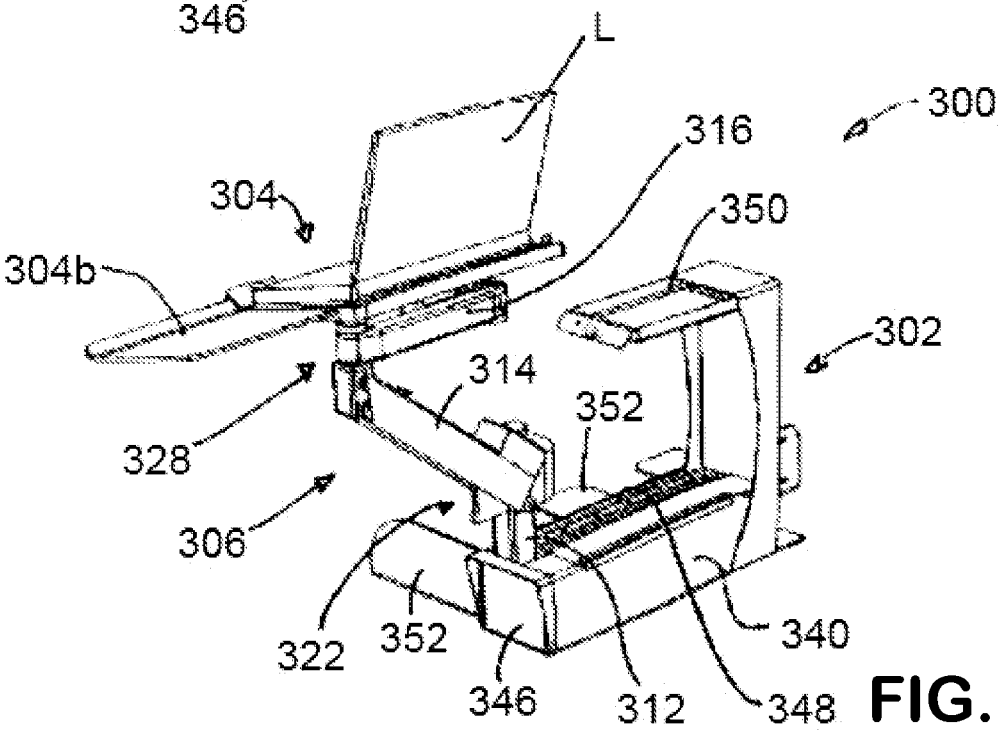
FIGS. 30 and 31 are rear perspective views of the support table device of FIG. 29 in a deployed position.

As better shown in FIGS. 29 and 30 the articulating arm 306 includes a bottom arm section or post 312, a median arm section 314 and a top arm section 316. The median arm section 314 is pivotally mounted at the bottom end thereof to the bottom post 312 via a pivot assembly 322. The top arm section 316 and median arm section 314 are interconnected via a pivot assembly 328. The top arm section 316 is pivotally connected to the table member 304 via a pivot assembly 334. Thus, the pivot assemblies or joints 322, 328 and 334 provide for the articulating arm 306 and the table member 304 to be moved from a stowed or retracted position as shown in FIG. 29 to a deployed or extended position as shown in FIGS. 30 and 31.

Figure 31:
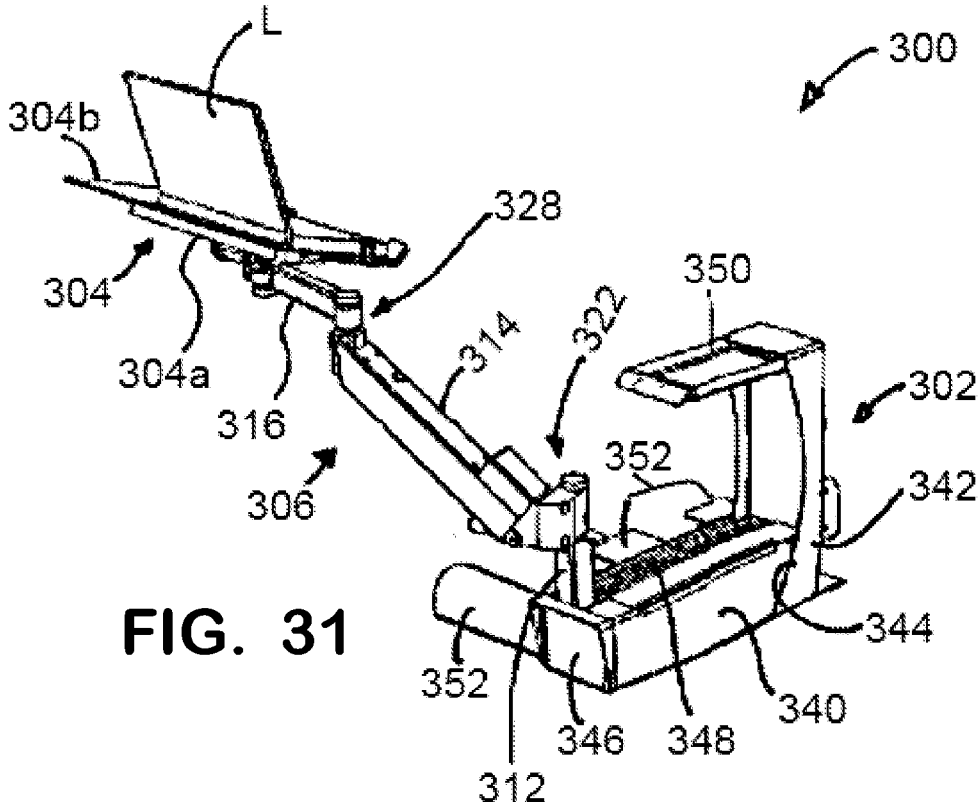

As shown in FIGS. 30 and 31, the table member 304 may include an auxiliary table element 304*b* which is slidably interconnected to a principal table element 304*a*. It is also shown in FIGS. 30 and 31 that the table member 304 may carry a laptop computer L or other articles thereon.

The base 302 includes a bottom longitudinal member 340 having a vertical member 342 mounted thereto at one end 344 thereof. The longitudinal member 340 also includes an opposite free end 346 as well as a railing 348 on the top face thereof. The bottom post arm section 312 of the articulating arm 306 is slidably connected to the railing 348 so as to reciprocally move from one end 344 to another end 346 of the longitudinal member 340, when stowing or deploying the articulating arm 306 with the table member 304. The vertical member 342 includes a short top member 350 mounted at its top end as such, the articulating arm 306 and the table member 304 can be housed within the partial space defined between members 350, 342 and 340 when stowed as is shown in FIG. 29. When deploying the articulating arm 306 and the table member 304, the user will move the bottom post 312 towards end 346 along the railing 348, when the articulating arm 306 and the table member 304 are stowed the user will move the bottom post towards end 344. The base 302 may also include a top cover attached thereto via piano hinges.

Furthermore, the longitudinal member 340 also includes three foot plates 352 which can be used to either add stability to the device 300 or to be mounted along the side of furniture such as a bed, a couch and the like. The foot plates may include a vertical component to add stability to the horizontal component.

Figure 32:
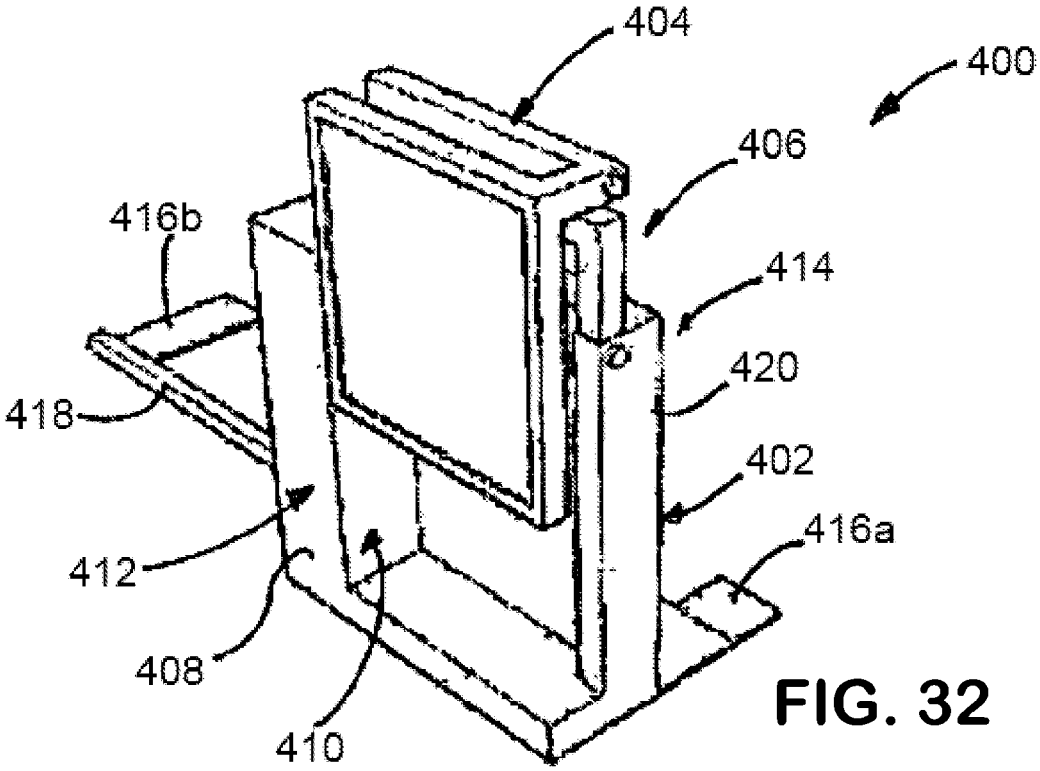
FIG. 32 is a front perspective view of the support table device in accordance with yet another illustrative embodiment of the present invention in a partially deployed position.

With reference to FIG. 32, a support table device 400 in accordance with another illustrative embodiment of the present invention will now be described.

The device 400 includes a base 402, a table member 404 as well as an articulating arm 406 mounted therebetween. In this example, the device 400 is shown in its almost fully stowed position. The base 402 comprises a main body 408 which has a generally rectangular configuration and defines a generally rectangular recess 410 at one side 412 thereof. The recess 410 serves to receive table member 404 therein when in the stowed position. On the other side 414 of the main body 408, the base 402 includes foot plates 416*a* and 416*b*. Foot plate 416*b* is mounted to an extension member 418. The articulating arm 406 is slidably mounted to a post element 420 of the base main body 408.

Figure 33:
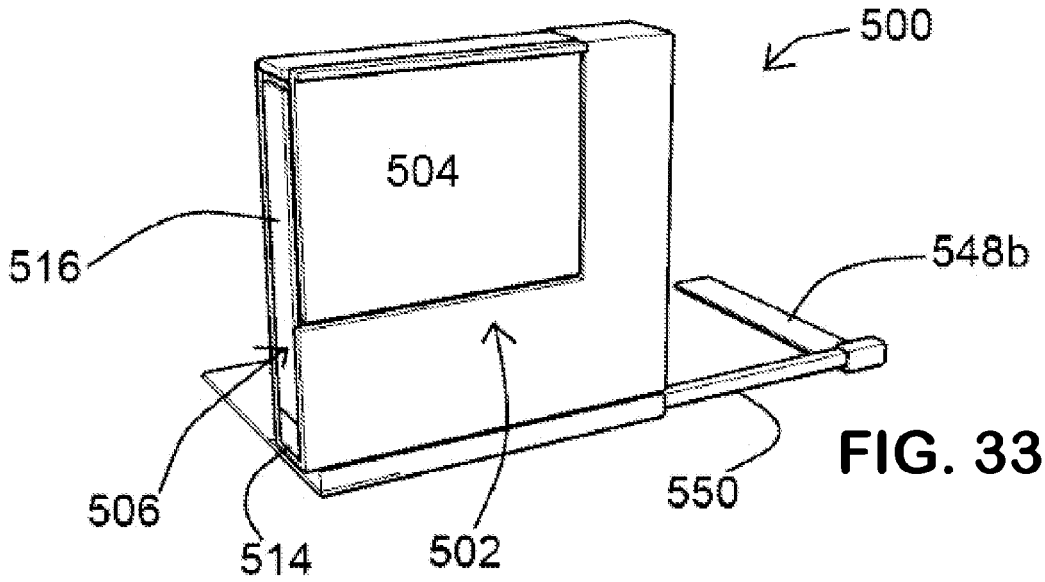
FIG. 33 is a front perspective view of the support table device in accordance with a further illustrative embodiment of the present invention in a stowed position and being mounted to a couch.
Figure 34:
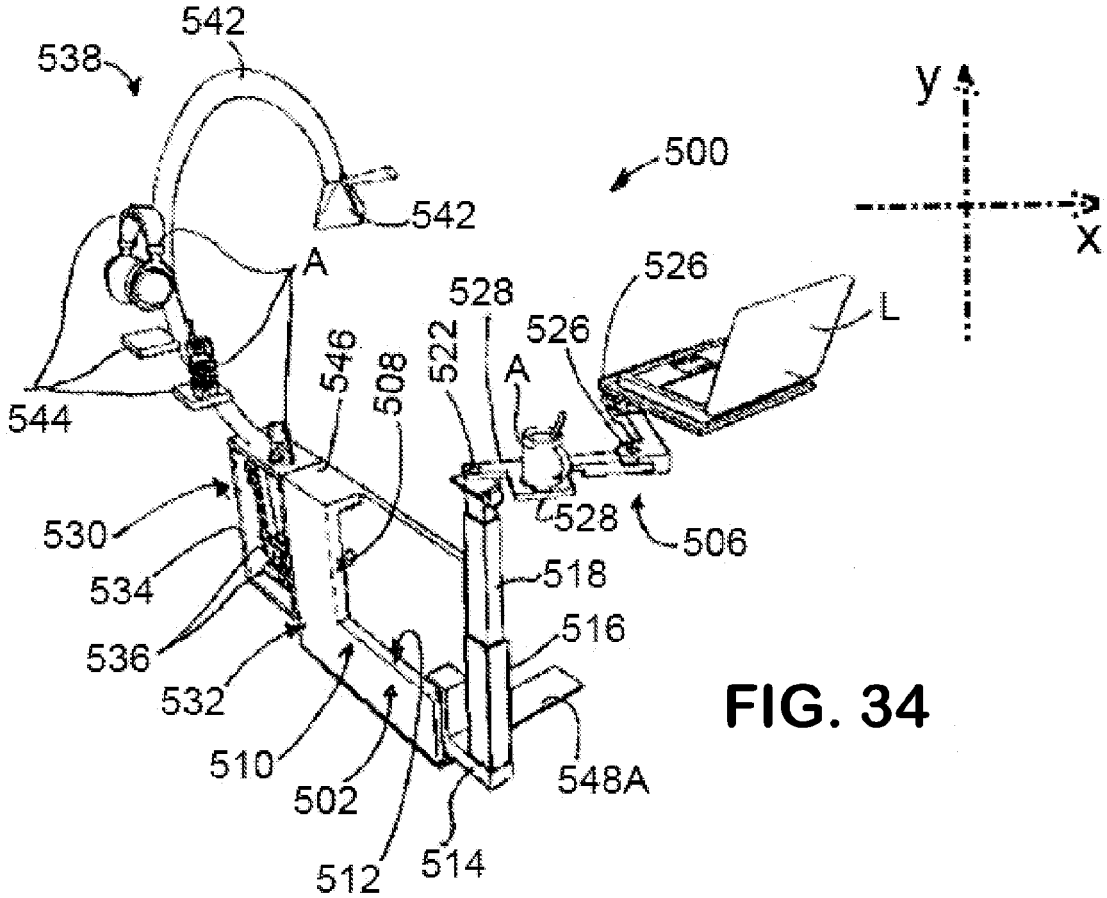
FIG. 34 is a front perspective view of the support table device of FIG. 33 in a deployed position.

With reference to FIGS. 33 and 34, a support table device 500 in accordance with a further illustrative embodiment of the present invention will now be described.

FIG. 33 shows the device 500 in a stowed position while FIG. 34 shows the device 500 in a deployed position. The device 500 includes a base 502, a table member 504 and an articulating arm 506 mounted therebetween. The base 502 includes a recess 508 at one side 510 thereof in order to receive the table member 504 when in the stowed position as shown in FIG. 33. Furthermore, the base 502 also includes a longitudinal opening 512 for movably or sidably receiving the arm base section 514. An arm post section 516 is mounted to the arm base section 512. A movable telescoping arm section 518 is slidably mounted to the post section 516. The telescoping section 518 can be moved out of or into the post 516. A first top arm section 520 is pivotally mounted to the arm telescoping section 518 via pivot 522. The first top arm section 520 is mounted to a second top arm section 524 via pivot 526. The second arm section 524 is pivotally mounted to the table member 504 via pivot 526. Therefore, the articulating arm 502 includes sections 514, 516, 518, 520 and 524. The slidable connection between the base arm section 514 and the longitudinal opening 512 of the base 502 provides for moving the post 516 towards or away from the base 502 as shown in FIGS. 33 and 3 respectively.

Pivot joints 522 and 526 respectively provide for the arm sections 520 and 524 to move along the Y axis. The pivot joint 526 provides for the table member 504 to be moved along the Y and X axis In this example, the arm section 520 includes a support element 528 for holding an article A thereon, such as a cup for example. An auxiliary unit 530 can be mounted on the side 532 of the base 502 which is opposite to the side, defined by the post section 516 and base section 514 when stowed. The unit 530 includes a main body 534 which can include support 536 for all the articles thereon. A lamp post 538 is mounted to the main body 534 and includes a flexible post 540 as well as light element 542 at the free end thereof. The post 540 can also include support 544 for placing a variety of articles A thereon. Of course, articles may also be positioned on the auxiliary unit main body 534 as well as on portion 546 of the base 502.

The base 502 also includes foot plates 548*a* and 548*b*. Foot plate 548*b* may be mounted to an extension member 550 which can be telescopingly mounted to the base 502. The foot plates 548*a* and 548*b* provide for such a device 500 to be mounted on the side of a couch for example.

Figure 35:
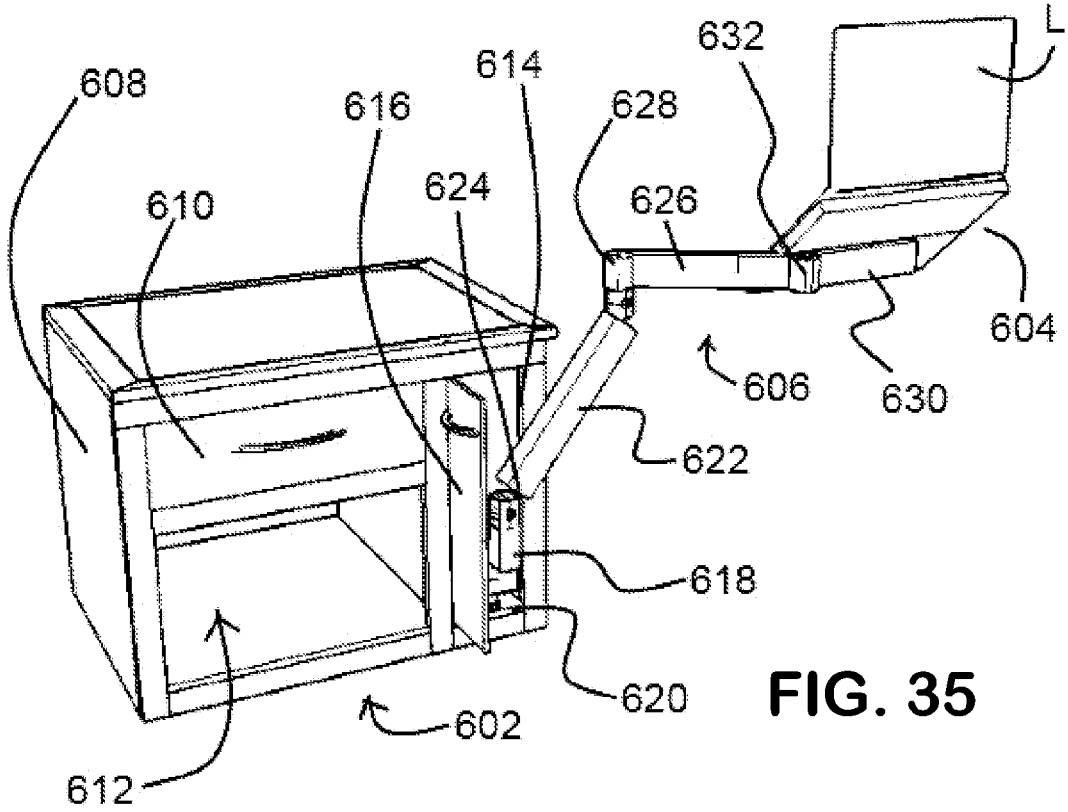
FIGS. 35 and 36 are perspective views of the support table device in accordance with still another illustrative embodiment of the present invention in a deployed position mounted to a night table and in use with a bed (FIG. 36 only)
Figure 36:
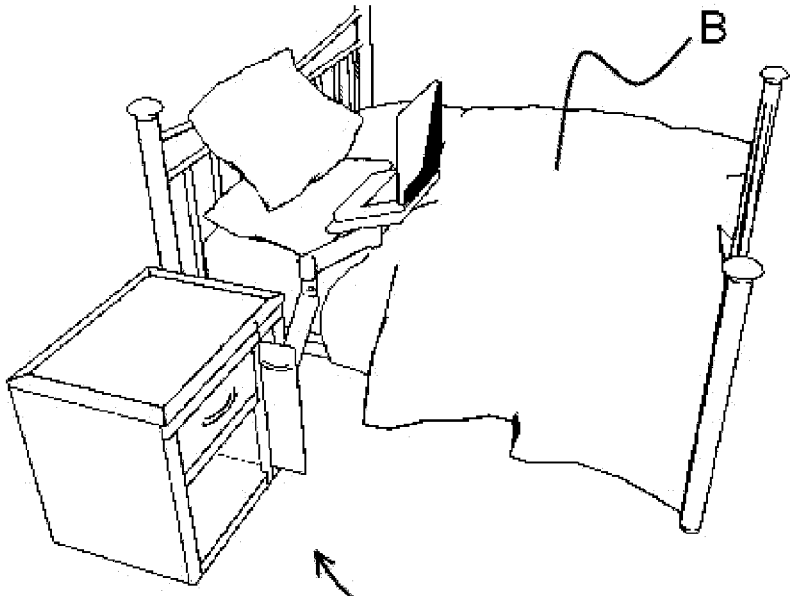

With reference to FIGS. 35 and 36, a support table device 600 in accordance with another illustrative embodiment thereof will now be described.

The device 600 includes a base 602, a table member 604 as well as an articulating arm 606 mounted therebetween. In this illustrative example, the base 602 comprises a night table 608 having a drawer 610 as well as a shelf space 612 and a secondary unit 614 with a door element 616. The articulating arm 606 is so configured and sized as to be positioned within the auxiliary unit 614 including the table member 604 for stowage thereof. As such, the articulating arm 606 comprises a bottom section 618 that is slidably mounted to the floor portion 620 of the auxiliary unit 614. Furthermore, an arm section 622 is pivotally mounted at pivot joint 624 to the bottom section 620. A first top arm section 626 is pivotally mounted at one end thereof to arm section 620 via pivot 628 and to a secondary arm section 630 via pivot 632 at the other end thereof. The table 604 is pivotally mounted to the secondary arm section 630 and is shown, in the present example, carrying a laptop computer L. One use of the present illustrative embodiment is shown in FIG. 36, where the device 600 is positioned near a bed B, allowing the user easy access to a laptop computer L for example.

Figure 37:
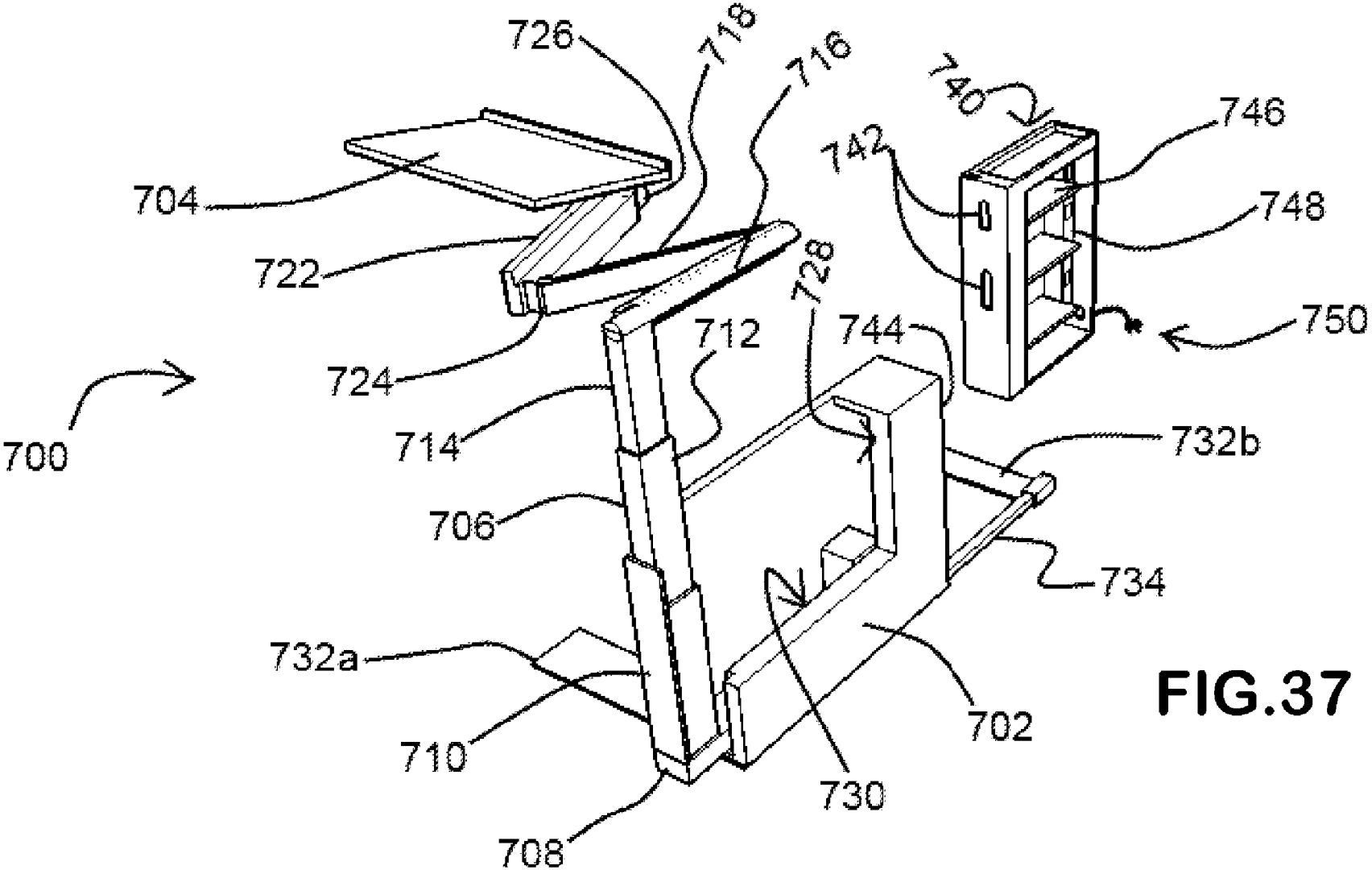
FIG. 37 is a side perspective view of the support table device in deployed position and of an optional storage compartment for mounting to the support table device.
Figure 38:
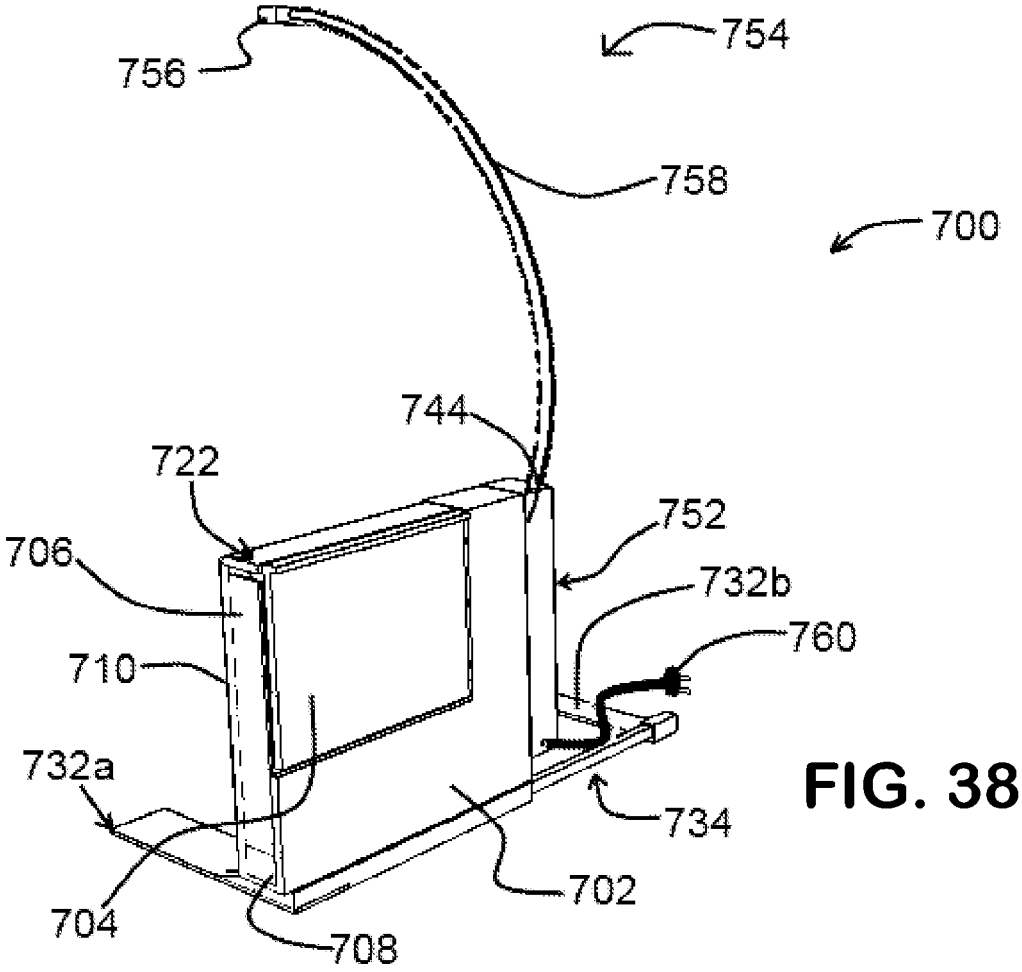
FIG. 38 is a side perspective view of the support table device in of FIG. 37 in a stowed position with an optional lamp module mounted thereto.
Figure 39:
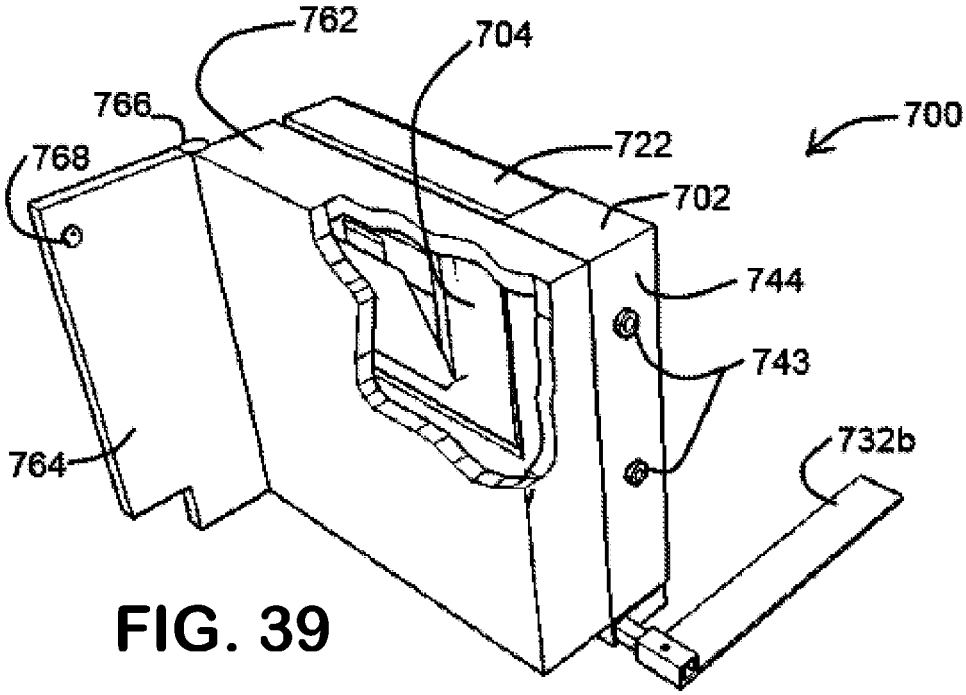
FIG. 39 is a side perspective view of the support table device in of FIG. 37 in a stowed position with an optional shell for a lap top computer mounted thereto.

With reference to FIGS. 37 to 39, a support table device 700 in accordance with another illustrative embodiment of the present invention will now be described.

FIG. 37 shows a support table device 700 in a deployed position, the device 700 includes a base 702, a table member 704 and an articulating arm 706 mounted there between.

The articulating arm 706 includes seven sections namely: a base section 708 which is slidably mounted to the base 702 as will be described herein; a vertical post section 710 mounted to the base section 708; a first vertical telescopic section 712 slidably connected to the post 710, a second vertical telescopic member 714 slidably and telescopingly connected to the first telescopic member 712; a first horizontal top arm section 716 mounted to the telescopic arm section 714 at one end thereof; a second horizontal top arm section 718 pivotally mounted to the first top arm section 716 via pivot joint 720; and a third horizontal top arm section 722 pivotally mounted to the second arm section 718 via a pivot joint 724. The table member 704 is pivotally mounted to the third top arm section 722 via a pivot joint 726.

The base 702 includes a generally rectangular recess portion 728 for receiving the table member 704 as is shown in FIG. 22. The base 702 also includes a longitudinal opening 730 which provides the arm base section 708 to be slidably mounted thereto so as to move inwardly and outwardly relative to the base 702 as is respectively shown in FIGS. 38 and 37. A pair of foot plates 732*a* and 732*b* are mounted to the base 702 on the side opposite that of the recess 728. Foot plate 732*b* is also mounted to an extension member 734 via a bracket 736 which provides for the foot plate 732*b* to be slidably adjustable along the extension member 734.

With reference to FIG. 39, when the articulating arm 706 is stowed from the deployed position (shown in FIG. 38), the telescoping section 714 is fitted into the telescoping section 712 which is then fitted within the post 710, the base section 708 is then moved inwardly into the longitudinal opening 730 and the table member 704 is fitted into recess 728 with the arm section 722, 718 and 716 forming an integral part of the casing 702 as its shown in FIG. 22.

Figure 20:
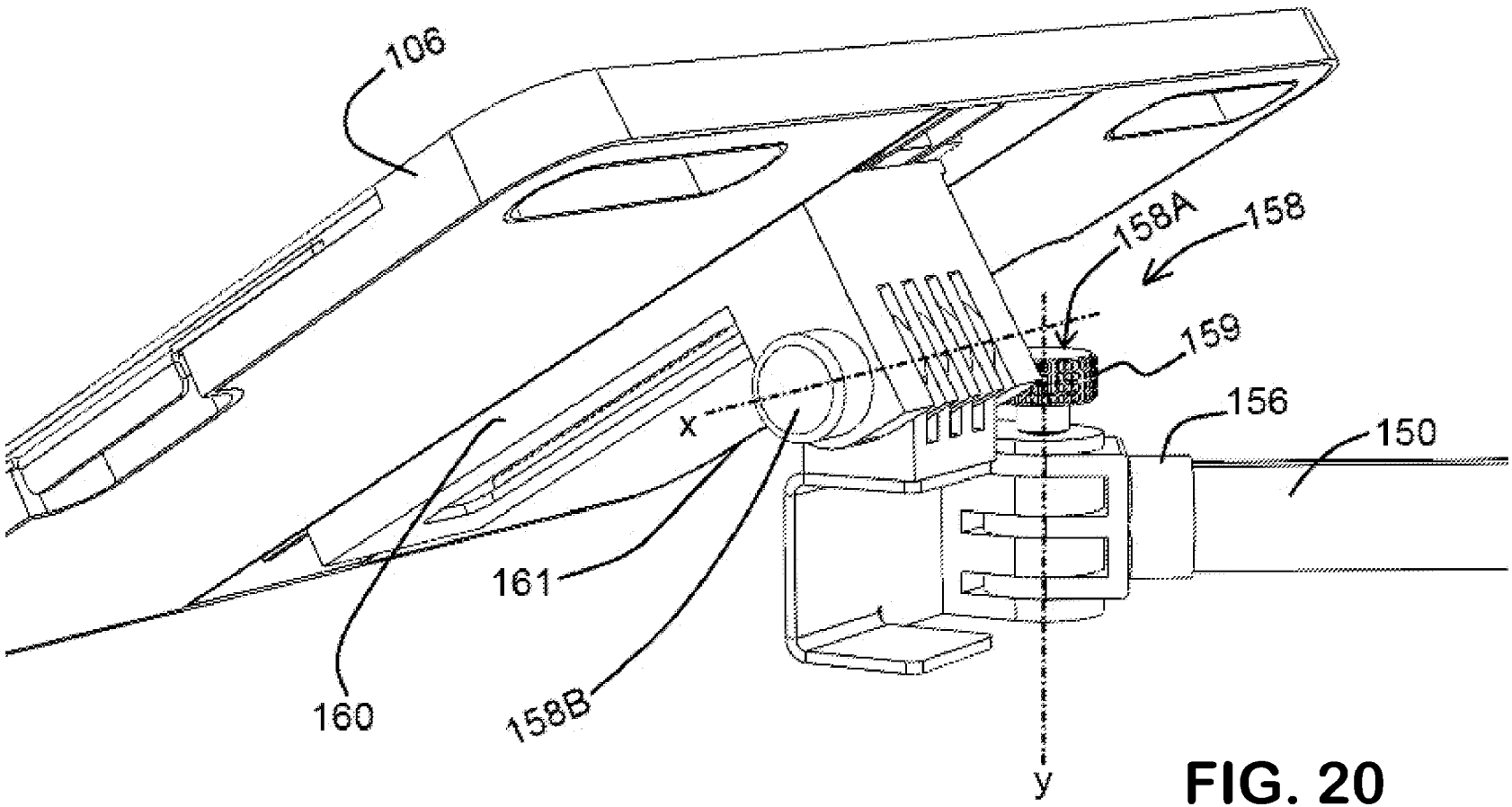
FIG. 20 is close-up perspective view of the of the support table of FIG. 15.

With reference to FIG. 37 an auxiliary member 740 is shown having a pair of connectors 742 at one side thereof so as to be connected on to side 744 of the base 702 as shown in FIG. 20 via connectors 743 (shown in FIG. 39). The auxiliary unit 740 includes a storage space 746, a power bar 748 as well as a power cord plug 750.

Of course, a variety of auxiliary units 740 can be contemplated within the scope of the invention, in this respect, turning now to FIG. 38 an auxiliary unit 752 is shown connected to side 744 up the base 702, the auxiliary unit 752 includes a lamp post 754 having a light element 756 connected to a curved post member 758. The auxiliary unit 752 also includes a power cord plug 764 for electric feed.

FIG. 39 shows an auxiliary unit 762 in the form of a generally rectangular shell unit mounted to the base 702 of the support table device 700. The shell 762 includes a door member 764 pivotally mounted to the shell 762 via a hinge 766, the door 764 also includes a locking element 768. The shell 762 can be used for a variety of purposes for example, storing of a portable computer.

Figure 40:
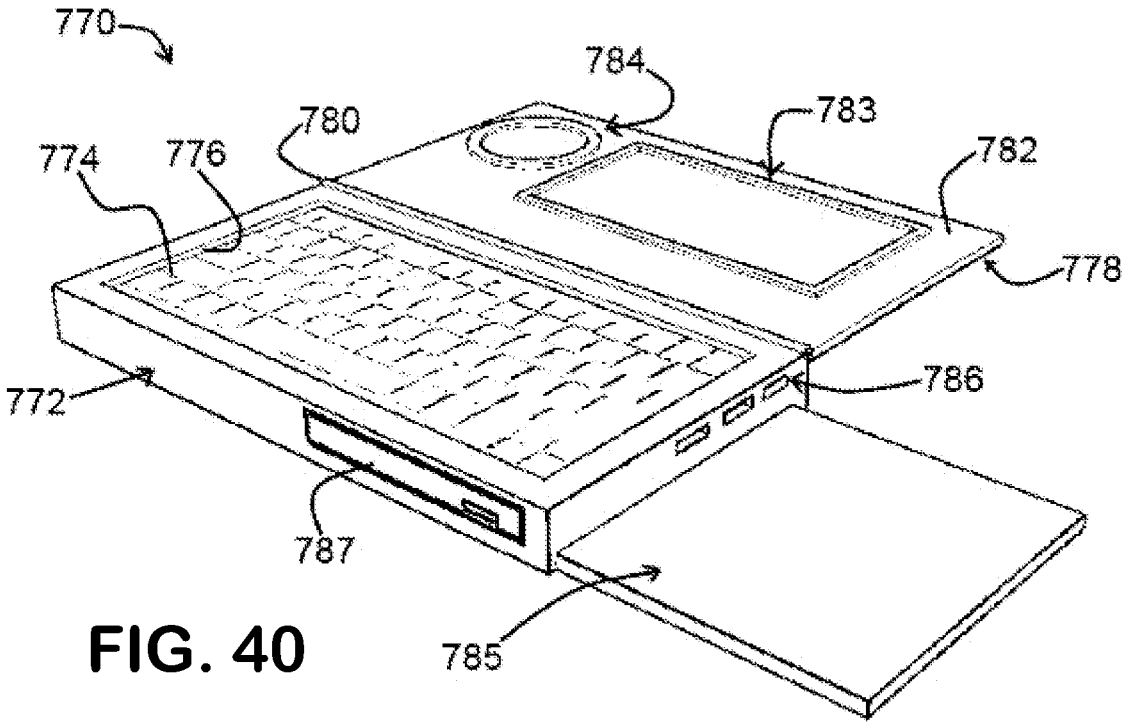
FIG. 40 is perspective view of the table member of the support table device in of FIG. 37.

FIG. 40 shows a table member 770 in accordance with a particular illustrative embodiment of the present invention.

The table member 770 includes a main body portion 772 which can receive a portable device such as a keyboard 774 within receiving space 776. The receiving space 776 can be closed by a lid member 778, hingeably connected to the main body portion 772 via hinge 780. The lid 778 includes on its inner side 782 a digital equipment retainer 783 as well as a cup holder 784. An auxiliary mouse pad 785 can also be slidably mounted to the main body portion 772. The main body portion 772 can also include memory or USP adaptor 786 as well as various media readers such as CD of DVD receiving sockets 787.

Figure 41:
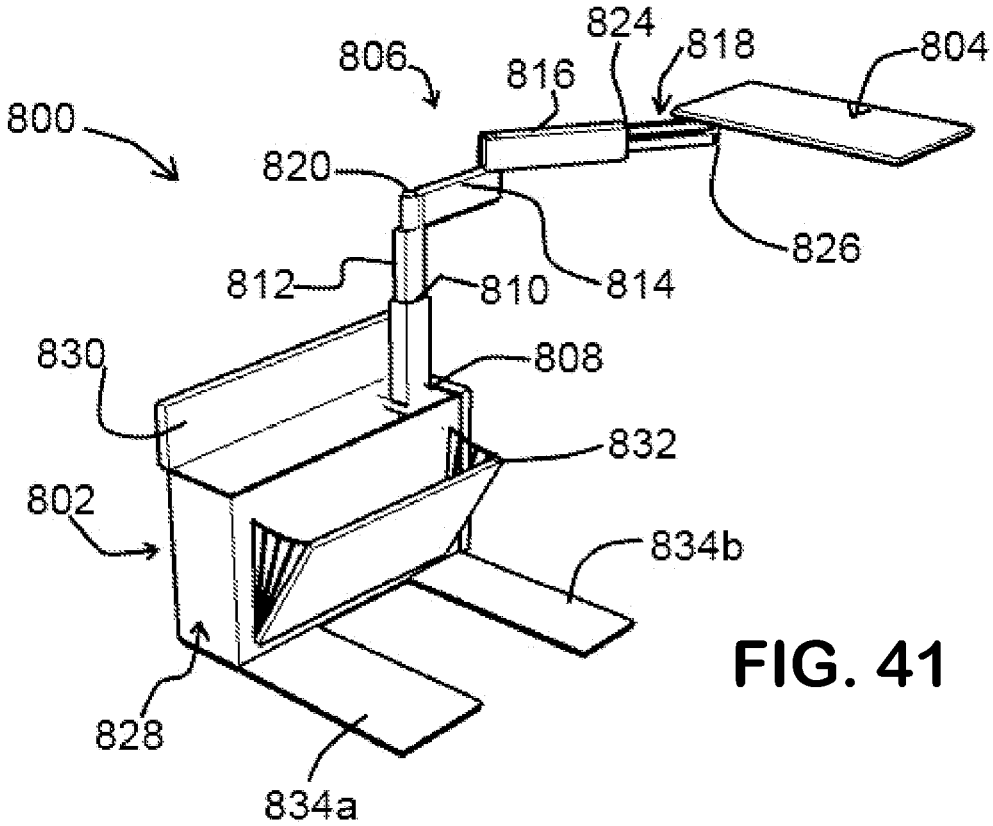
FIG. 41 perspective view of the support table device in accordance with still yet another illustrative embodiment of the present invention in a deployed position.

FIG. 41 shows a support table device 800 in accordance with another illustrative embodiment of the present invention.

The device 800 includes a base 802, a table member 804 as well as an articulating arm 806 mounted therebetween.

The auxiliary arm 806 includes a vertical post 808 mounted to the base 802 as will be further detailed below. First and second vertical telescoping members 810 and 812, respectively, are slidingly and telescopingly mounted to the vertical post 808. First, second and third horizontal top arm sections 814, 816 and 818, respectively provide, a horizontal configuration and are mounted to the vertical configuration defined by members 808, 810 and 812 at pivot joint assembly 820 which is mounted between the first top arm section 814 and the second telescoping member 812. The second top arm section 816 is mounted to the first top arm section 814 at pivot joint 822. The third and second arm sections 818 and 816, respectively, are pivotally interconnected at pivot joint 824. Finally, the third arm section 818 is pivotally connected to the table 804 via pivot joint 826 which can be a ball joint for example in order to provide a variety of tilt movements to the table 804.

Returning to the base 802, it is shown including a main body 828 in the form of a generally rectangular shell having a top door element 830, which encloses the articulating arm 806 and the 804 when in the stowed position. The main body shell 828 also includes a side holder 832 as well as foot plates 834*a* and 834*b*.

Figure 42:
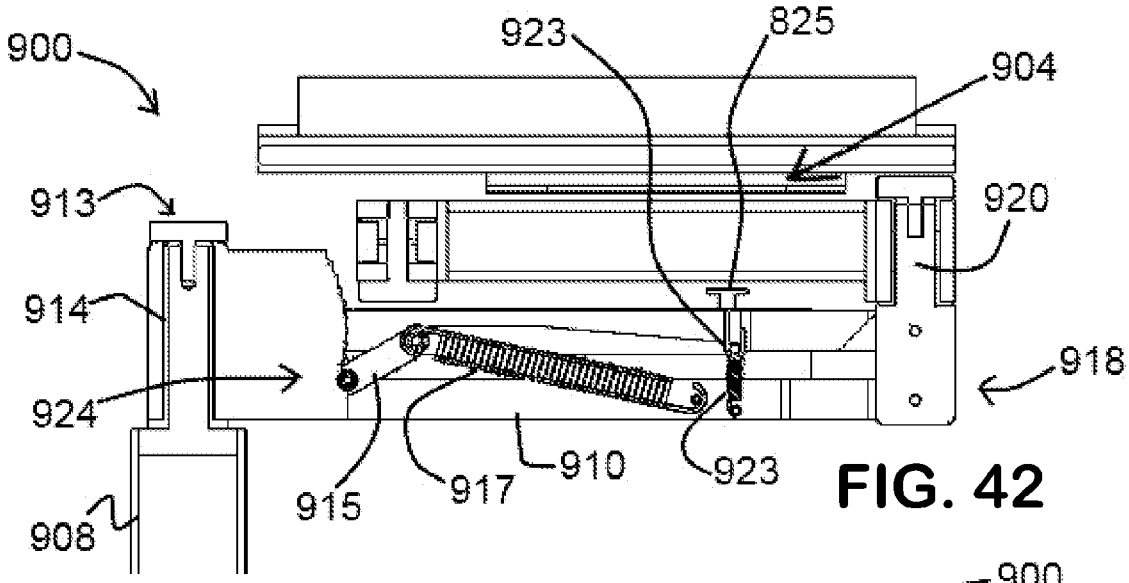
FIG. 42 is a front sectional view of the support table in accordance with another illustrative embodiment of the present invention.
Figure 43:
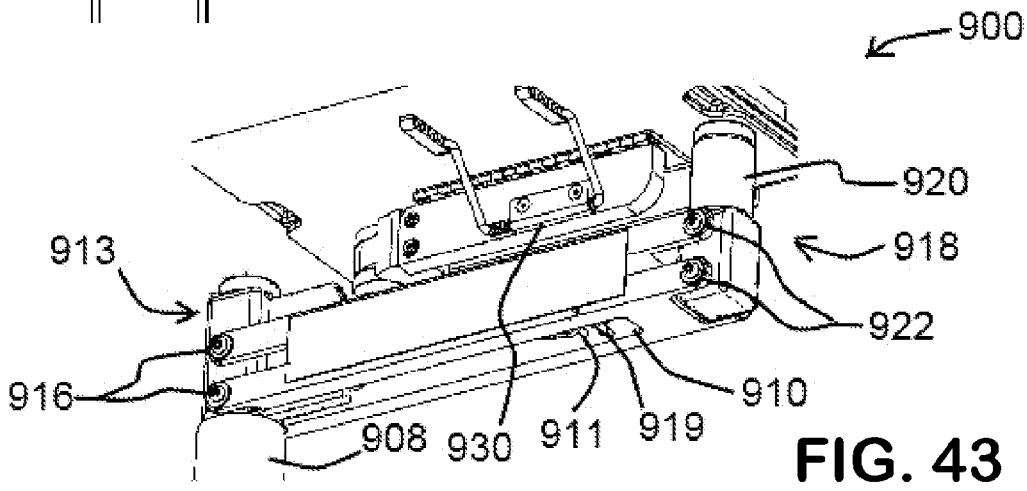
FIG. 43 is an underside prospective view of the support table of FIG. 42.
Figure 44:
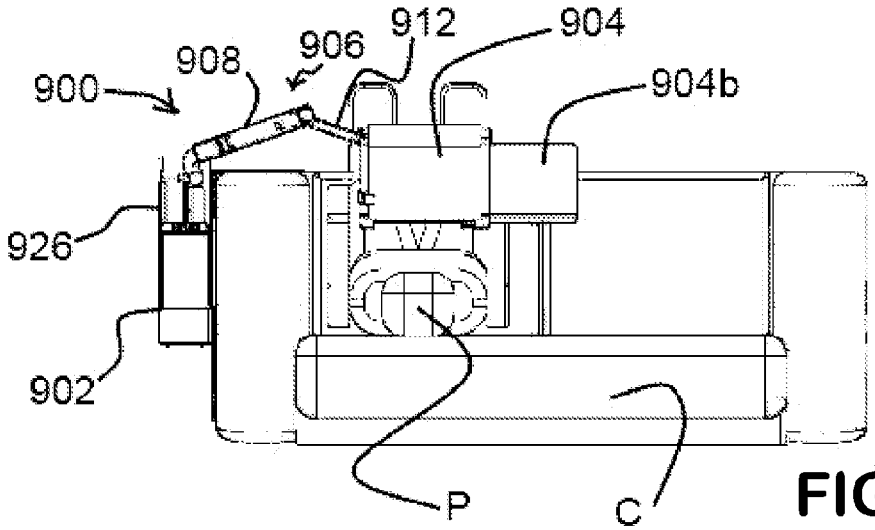
FIG. 44 is a top plan view of the support table of FIG. 42.

With reference now to FIGS. 42, 43, and 44 a table device 900, in accordance with a ninth illustrative embodiment will be described.

The device 900 includes a base 902, a table member 904 and an articulating arm 906 therebetween.

The articulating arm 906 includes three arm sections, namely a post section 908, a median section 910 and a top section 912. The median section 910 is pivotally mounted to the post section 908 via pivot assembly 913 which includes pivot 914 and pivots 916. Pivot 914 provide pivotal movement about the vertical axis, and via pivots, pivots 916 provide pivotal movement about the horizontal axis. The median section 910 is mounted to the top section 912 via pivot assembly 918 which includes pivot 920 and pivots 922.

The median arm section 910 may also include an internal locking mechanism 924, acting against the biasing force exerted thereon by a main spring 917, and thereby providing a safety release feature in case of an overload. Pins 911 and 919 are spring holders for the main spring 917. The end of a pivotally mounted member 915, composed of a series bearings (not numbered), is pushed in small half-circle notches (not numbered) by one or more springs 923 pulling on the other end of member 915, thus providing an effective lock of the median arm section 910. The locking mechanism 924 is released by pulling on the release button 925, hooked on one end of member 915, effectively pulling the springs 923, and moving the member 915 out of half-circle notches. The pulling action of spring 923 and the depth of the half-circle notches, will determine the overload weight of the safety release feature.

As shown in FIG. 44, the median section 910 may be mounted to the post member 908 via an L shaped extension element 926.

FIG. 44 also shows that the table member 904 includes an auxiliary table element 904*b*. In use, the device 900 can be paired to a couch C to be used by a person P, to give but one practical example.

As shown in FIG. 42, the top section 912 is mounted to the table member 904 by way of adjustable mounting elements 928*a* and 928*b* that are spring loaded to the top section 912 via receiving element 930 and spring 932.

Having now described a variety of illustrative embodiments of the present invention it should be noted that various structures, features and characteristics are included within the scope of the foregoing illustrative embodiments. For example, the various posts and telescopic members can be brought to a desired height and length with the aid of spring members or compressed air cylinders or electric motors and may also be restrained by trapped air inside these members or with one or more compressed air cylinders or via springs. The various arm sections may be in the form of horizontal support members which include a variety of extension members as well as a variety of joints having friction locks for example. The various horizontal arm sections or supports may be hollow or may include clips to house a variety of electrical wires which can be used for wiring various electrical devices. The joints described herein can be provided by various pivot assemblies including hinges, single pivot assemblies or ball joints, hence, various universal joints can also be contemplated within the scope of the present invention. The lamp modules described above can be in the form of halogen or LED type and may have a flexible post. Of course, still other embodiments can also be contemplated within the scope of the present invention. Finally, various materials can also be used for the construction of the present devices. The devices may come in different sizes for a variety of eventual uses.

It should also be noted that the various components and features of the devices described above can be combined in a variety of ways so as to provide other non-illustrated embodiments within the scope of the invention.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation. Hence, although the present invention has been described hereinabove by way of embodiments thereof, it can be modified, without departing from the spirit, scope and nature of the subject invention.

What is claimed is:

1. A support table device comprising:

a base for being positioned on a surface;

a table member for supporting articles thereon; and an articulating arm mounted at one end thereof to said base, said table member being pivotally mounted to said articulating arm at the other end thereof, said articulating arm comprising at least two arm segments joined about an arm joint therebetween for relative pivotal movement, said at least two arm segments comprise a proximal arm segment positioned between said base and said arm joint and a distal arm segment positioned between said arm joint and said table, said arm joint provides for said distal arm segment to be pivoted about a vertical axis relative to said proximal arm segment, said arm joint comprises a vertical shaft, said distal arm segment being mounted to said vertical shaft, said proximal arm segment being pivotally mounted to said arm joint about a pivot axis generally orthogonal to the vertical axis of said vertical shaft, said proximal arm segment comprises a first fixed gear about an end thereof mounted to said base and a second rotatable gear about an end thereof mounted to said arm joint, a conveyor being mounted to said first and second gears;

wherein said articulating arm and table member are movable between a stowed position wherein said table member is near said base and a deployed position wherein said table member is away from said base.

2. A support table device according to claim 1, wherein said articulating arm is pivotally mounted to said base about a base joint.

3. A support table device according to claim 2, wherein said base joint comprises a universal joint for providing said articulating arm to pivot about a horizontal axis and a vertical axis relative to said base.

4. A support table device according to claim 2, wherein said articulating arm is lockable into position relative said base.

5. A support table device according to claim 1, wherein said proximal arm segment is mounted to said base about a base joint providing for said proximal arm segment to pivot about a horizontal axis relative to said base thereby being movable between an upward and downward position.

6. A support table according to claim 1, wherein said vertical shaft is maintained in a vertical position as said proximal arm segment moved between upward and downward positions.

7. A support table device according to claim 6, wherein said proximal arm segment is mounted to said base about a base joint providing for said proximal arm segment to pivot about a horizontal axis relative to said base thereby being movable between an upward and downward position.

8. A support table device according to claim 7, wherein said proximal arm segment comprises an air-cylinder for being pushed thereby in said upward position and being pulled thereby in said downward position.

9. A support table device according to claim 1, wherein said base comprises a longitudinal member and a movable member being movable along the length of said longitudinal member, said articulating arm being mounted to said movable member.

10. A support table device according to claim 9, wherein said longitudinal member comprises a beam, said moveable member comprises a carrier having rollers for rollingly engaging said beam.

11. A support table device according to claim 9, wherein said movable member comprises a stopper for engaging said longitudinal member thereby preventing said movable member from moving along the length of said longitudinal member.

12. A support table device according to claim 11, wherein said stopper is biased towards said longitudinal member, said device further comprising a lever in operational communication with said stopper for pulling said stopper away from said longitudinal member.

13. A support table device according to claim 1, wherein said base comprises a longitudinal member mounted to a pair of feet members, said longitudinal member being mountable along the length of said feet members.

14. A support table device according to claim 1, wherein said articulating arm movably mounted to said base so as to move along the length thereof.

15. A support table device according to claim 1, wherein said articulating arm comprises mounting elements for mounting wires thereto extending from an article on said table member.

16. A support table device according to claim 1, wherein said table member is lockable into position about said articulating arm.

17. A support table device according to claim 1, wherein said at least two arm segments are lockable into position relative to one another.

18. A support table device comprising:

a base for being positioned on a surface and comprising a longitudinal member and a movable member being movable along the length of said longitudinal member, said movable member comprising a stopper for engaging said longitudinal member thereby preventing said movable member from moving along the length of said longitudinal member, said stopper being biased towards said longitudinal member;

a table member for supporting articles thereon; and an articulating arm mounted at one end thereof to said movable member at one end thereof, said table member being pivotally mounted to said articulating arm at the other end thereof, said articulating arm comprising at least two arm segments joined about an arm joint therebetween for relative pivotal movement; and a lever in operational communication with said stopper for pulling said stopper away from said longitudinal member;

wherein said articulating arm and table member are movable between a stowed position wherein said table member is near said base and a deployed position wherein said table member is away from said base.

* * * * *